US009274499B2

(12) United States Patent
Morioka et al.

(10) Patent No.: US 9,274,499 B2
(45) Date of Patent: Mar. 1, 2016

(54) CARTRIDGE AND IMAGE FORMING APPARATUS

(71) Applicant: CANON KABUSHIKI KAISHA, Tokyo (JP)

(72) Inventors: Masanari Morioka, Yokohama (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/689,431

(22) Filed: Apr. 17, 2015

(65) Prior Publication Data

US 2015/0220051 A1 Aug. 6, 2015

Related U.S. Application Data

(62) Division of application No. 13/713,117, filed on Dec. 13, 2012, now Pat. No. 9,025,998.

(30) Foreign Application Priority Data

Dec. 27, 2011 (JP) ..... 2011-286356

(51) Int. Cl.
*G03G 21/16* (2006.01)
*G03G 21/18* (2006.01)

(52) U.S. Cl.
CPC ..... *G03G 21/1842* (2013.01); *G03G 21/1817* (2013.01); *G03G 21/1821* (2013.01); *G03G 21/1828* (2013.01); *G03G 21/1825* (2013.01); *G03G 21/1853* (2013.01)

(58) Field of Classification Search
CPC ..... G03G 21/1817; G03G 21/1821; G03G 21/1825; G03G 21/1828; G03G 21/1853
USPC ..... 399/110, 111, 113, 116, 119
See application file for complete search history.

(56) References Cited

U.S. PATENT DOCUMENTS 5,729,796 A 3/1998 Miura et al.
5,768,658 A 6/1998 Watanabe et al.

(Continued)

FOREIGN PATENT DOCUMENTS

JP 7152224 6/1995
JP 2001-117466 4/2001

(Continued)

OTHER PUBLICATIONS

Office Action in Chinese Patent Application No. 201210579320.8, dated Jun. 30, 2014 (with English translation).

*Primary Examiner* — Hoang Ngo
(74) *Attorney, Agent, or Firm* — Fitzpatrick, Cella, Harper & Scinto

(57) ABSTRACT

A process cartridge includes: a first unit including a photosensitive drum; a second unit, including a process member, movable to a spaced position and to a close position; and a spacer member for holding the second unit at the spaced position. The spacer member includes a contact portion for holding the second unit at the spaced position and includes a portion-to-be-phase-determined for preventing rotation of the spacer member by being engaged with a phase-determining portion provided in the second unit. The spacer member is rotated, by receiving a force from the drum at the contact portion when the drum is rotated, against a force with which the phase-determining portion determines a rotational position of the spacer member, and eliminates a contact state of the contact portion with the drum to permit movement of the second unit from the spaced position to the close position.

48 Claims, 21 Drawing Sheets

(56) References Cited

U.S. PATENT DOCUMENTS

| | | | | |
|---|---|---|---|---|
| 5,815,644 | A | 9/1998 | Nishiuwatoko et al. | |
| 5,870,655 | A | 2/1999 | Nishiuwatoko et al. | |
| 5,893,006 | A | 4/1999 | Kanno et al. | |
| 5,926,666 | A | 7/1999 | Miura et al. | |
| 5,937,240 | A | 8/1999 | Kanno et al. | |
| 5,940,657 | A | 8/1999 | Yokomori et al. | |
| 5,950,049 | A | 9/1999 | Yokomori et al. | |
| 6,070,029 | A | 5/2000 | Nishiuwatoko et al. | |
| 6,072,969 | A | 6/2000 | Yokomori et al. | |
| 6,345,164 | B1 | 2/2002 | Yokomori et al. | |
| 6,381,430 | B1 | 4/2002 | Yokomori et al. | |
| 6,496,667 | B2 | 12/2002 | Shiratori et al. | |
| 6,516,168 | B2 | 2/2003 | Shiratori et al. | |
| 6,560,422 | B2 | 5/2003 | Kanno et al. | |
| 6,665,507 | B1 | 12/2003 | Hooper, III et al. | |
| 6,681,088 | B2 | 1/2004 | Kanno et al. | |
| 6,704,522 | B2 | 3/2004 | Sasago et al. | |
| 6,714,746 | B2 | 3/2004 | Morioka et al. | |
| 6,735,403 | B2 | 5/2004 | Kanno et al. | |
| 6,834,173 | B2 | 12/2004 | Yamaguchi et al. | |
| 6,898,399 | B2 | 5/2005 | Morioka et al. | |
| 6,937,832 | B2 | 8/2005 | Sato et al. | |
| 6,937,834 | B2 | 8/2005 | Kanno et al. | |
| 6,947,686 | B2 * | 9/2005 | Kawai et al. | 399/111 |
| 6,947,687 | B2 | 9/2005 | Yamaguchi et al. | |
| 6,961,528 | B2 | 11/2005 | Yamaguchi et al. | |
| 6,963,706 | B2 | 11/2005 | Morioka et al. | |
| 6,980,759 | B2 | 12/2005 | Kanno et al. | |
| 7,058,337 | B2 | 6/2006 | Hashimoto et al. | |
| 7,079,787 | B2 | 7/2006 | Ogino et al. | |
| 7,127,192 | B2 | 10/2006 | Batori et al. | |
| 7,184,686 | B2 | 2/2007 | Kanno et al. | |
| 7,200,349 | B2 | 4/2007 | Sato et al. | |
| 7,221,888 | B2 * | 5/2007 | Hymas et al. | 399/111 |
| 7,418,225 | B2 | 8/2008 | Morioka et al. | |
| 7,463,844 | B2 | 12/2008 | Hashimoto et al. | |
| 7,756,441 | B2 | 7/2010 | Kanno et al. | |
| 7,929,881 | B2 | 4/2011 | Yoshino et al. | |
| 7,933,534 | B2 | 4/2011 | Hoshi et al. | |
| 8,059,988 | B2 | 11/2011 | Kanno et al. | |
| 8,090,292 | B2 | 1/2012 | Kanno et al. | |
| 8,135,304 | B2 | 3/2012 | Abe et al. | |
| 8,155,557 | B2 | 4/2012 | Kanno et al. | |
| 8,170,444 | B2 | 5/2012 | Kanno et al. | |
| 8,170,445 | B2 | 5/2012 | Kanno et al. | |
| 8,270,876 | B2 | 9/2012 | Morioka et al. | |
| 8,275,286 | B2 | 9/2012 | Ueno et al. | |
| 8,280,278 | B2 | 10/2012 | Ueno et al. | |
| 8,295,734 | B2 | 10/2012 | Ueno et al. | |
| 8,385,775 | B2 | 2/2013 | Kanno et al. | |
| 8,452,210 | B2 | 5/2013 | Ueno et al. | |
| 8,472,840 | B2 | 6/2013 | Abe et al. | |
| 2007/0248382 | A1 | 10/2007 | Oguma et al. | |
| 2008/0240796 | A1 | 10/2008 | Morioka et al. | |
| 2011/0038649 | A1 | 2/2011 | Miyabe et al. | |
| 2011/0142487 | A1 | 6/2011 | Anan et al. | |
| 2011/0170903 | A1 | 7/2011 | Hoshi et al. | |
| 2012/0163861 | A1 | 6/2012 | Kanno et al. | |
| 2012/0177404 | A1 | 7/2012 | Kanno et al. | |
| 2013/0064569 | A1 | 3/2013 | Ueno et al. | |
| 2013/0164031 | A1 | 6/2013 | Ueno et al. | |
| 2013/0209137 | A1 | 8/2013 | Hayashi et al. | |
| 2013/0216275 | A1 | 8/2013 | Morioka et al. | |

FOREIGN PATENT DOCUMENTS

| | | |
|---|---|---|
| JP | 2002-006722 | 1/2002 |
| JP | 2003-076117 | 3/2003 |
| JP | 2006-276190 | 10/2006 |
| JP | 2006337725 | 12/2006 |
| JP | 2007-058058 | 3/2007 |
| JP | 2007-289545 | 11/2007 |

* cited by examiner (a)

(b)

(a)

(b)

(a)

(b)

(a)

(b)

(a)

(b)

CARTRIDGE AND IMAGE FORMING APPARATUS

FIELD OF THE INVENTION AND RELATED ART

The present invention relates to an image forming apparatus of an electrophotographic type (electrophotographic image forming apparatus) and a process cartridge for use with the image forming apparatus.

The electrophotographic image forming apparatus is an apparatus for forming an image on a recording material (medium) by using an electrophotographic process. Examples of the electrophotographic image forming apparatus may include a copying machine, a printer (laser beam printer, LED printer or the like), a facsimile machine, a word processor, and the like.

Further, the process cartridge is prepared by integrally assembling an electrophotographic photosensitive member as an image bearing member and at least one of process member (process means acting on the photosensitive member into a cartridge, which is detachably mountable to a main assembly of the image forming apparatus. Examples of the process member include a charging member, a developing member and a cleaning member.

In a conventional electrophotographic image forming apparatus, a process cartridge type in which the process cartridge is detachably mountable to the main assembly of the image forming apparatus is widely employed.

For example, a developing device configured to be incorporated into the process cartridge generally includes, as a developing means, a rotatable developer carrying member for supplying a developer to the photosensitive member. As the developer carrying member, in some cases, a developing roller constituted by using an elastic member such as a rubber is used.

For example, when the elastic member such as the rubber used for the developing roller is kept contact with the photosensitive member in a period from manufacturing until a user starts use of the image forming apparatus, the elastic member is deformed and a substance which bleeds therefrom, thus adversely affecting the photosensitive member in some cases.

Therefore, in a conventional constitution, as a material for the elastic member used for the process member, such as the developing roller, acting on the photosensitive member, a material which does not readily cause deformation and deterioration has been selected. Further, as another countermeasure, in order to increase the number of options of the material usable for the process member, a constitution in which the process cartridge and the photosensitive member are maintained in a spaced state and are shipped has been proposed (Japanese Laid-Open Patent Application (JP-A) Hei 7-152224).

Specifically, in the invention of JP-A Hei 7-152224 publication, an electroconductive rubber roller is used as the process member for electrically charging the photosensitive member is used, and a one-way clutch is mounted on a supporting shaft of the electroconductive rubber roller. The one-way clutch includes a gear engageable with a gear provided on a flange at a side end of a photosensitive drum with respect to a rotational axis direction. Then, in an engaged state of both of the gears, the photosensitive drum and the electroconductive rubber roller are configured to be spaced. The one-way clutch is rotationally moved in a free direction by normal rotation of the photosensitive drum, so that the spaced state is eliminated (released). Further, the one-way clutch is urged in the free direction by a tension spring. However, the conventionally proposed constitution in which the process member and the photosensitive member are kept in the spaced state by using a spacer member and is shipped, e.g., when these members are subjected to strong vibration during distribution or storage, there was a possibility that the spaced state by the spacer member was eliminated.

For example, in the constitution described in JP-A Hei 7-152224, when the process member and the photosensitive member are subjected to strong impact and thus a force is exerted thereon in a direction in which the photosensitive drum and the electroconductive rubber member are spaced, there is a possibility that the engagement between the both gears is eliminated. Further, at the same time, there is a possibility that the one-way clutch urged in the free direction is rotationally moved to eliminate the spaced state between the photosensitive drum and the electroconductive rubber roller.

For that reason, in the conventional constitution, there was a problem such that a cost of a packing material for suppressing the vibration during distribution or storage was increased.

Incidentally, even with respect to the process member which does not contact the photosensitive member during use, in some cases, it is desired that the process member is more spaced from the photosensitive member than during use in order to prevent inadvertent contact with the photosensitive member during distribution or storage before use. Also in such a case, it is desired that a more spaced state between the process member and the photosensitive member is not eliminated before use.

SUMMARY OF THE INVENTION

A principal object of the present invention is to provide a process cartridge and an image forming apparatus which are capable of maintaining a state in which a photosensitive member and a process member are more spaced than during use with reliability until the use is started.

According to an aspect of the present invention, there is provided a process cartridge detachably mountable to a main assembly of an image forming apparatus, comprising: a first unit including an image bearing member on which a latent image is to be formed; a second unit, including a process member actable on the image bearing member, movable to a spaced position where the process member is spaced from the image bearing member and to a close position where the process member is closer to the image bearing member than that at the spaced position; and a spacer member, rotatably provided in the second unit, for holding the second unit at the spaced position, wherein the spacer member includes a contact portion for holding the second unit at the spaced position in contact with the image bearing member or an end portion member provided at an end portion of the image bearing member with respect to a rotational axis direction of the image bearing member, and includes a portion-to-be-phase-determined for preventing rotation of the spacer member by being engaged with a phase-determining portion provided in the second unit, and wherein the spacer member is rotated, by receiving a force from the image bearing member or the end portion member at the contact portion when the image bearing member is rotated, against a force with which the phase-determining portion determines a position of the spacer member with respect to a rotational direction of the spacer member, and eliminates a contact state of the contact portion with the image bearing member or the end portion member to permit movement of the second unit from the spaced position to the close position.

According to another aspect of the present invention, there is provided an image forming apparatus for forming an image on a recording material, comprising: a first unit including an image bearing member on which a latent image is to be formed; a second unit, including a process member actable on the image bearing member, movable to a spaced position where the process member is spaced from the image bearing member and to a close position where the process member is closer to the image bearing member than that at the spaced position; a spacer member, rotatably provided in the second unit, for holding the second unit at the spaced position; and an apparatus main assembly, including the first unit and the second unit therein, for transmitting to the first unit a driving force for rotating the image bearing member, wherein the spacer member includes a contact portion for holding the second unit at the spaced position in contact with the image bearing member or an end portion member provided at an end portion of the image bearing member with respect to a rotational axis direction of the image bearing member, and includes a portion-to-be-phase-determined for preventing rotation of the spacer member by being engaged with a phase-determining portion provided in the second unit, and wherein the spacer member is rotated, by receiving a force from the image bearing member or the end portion member at the contact portion when the image bearing member is rotated, against a force with which the phase-determining portion determines a position of the spacer member with respect to a rotational direction of the spacer member, and eliminates a contact state of the contact portion with the image bearing member or the end portion member to permit movement of the second unit from the spaced position to the close position.

These and other objects, features and advantages of the present invention will become more apparent upon a consideration of the following description of the preferred embodiments of the present invention taken in conjunction with the accompanying drawings.

Figure 10:
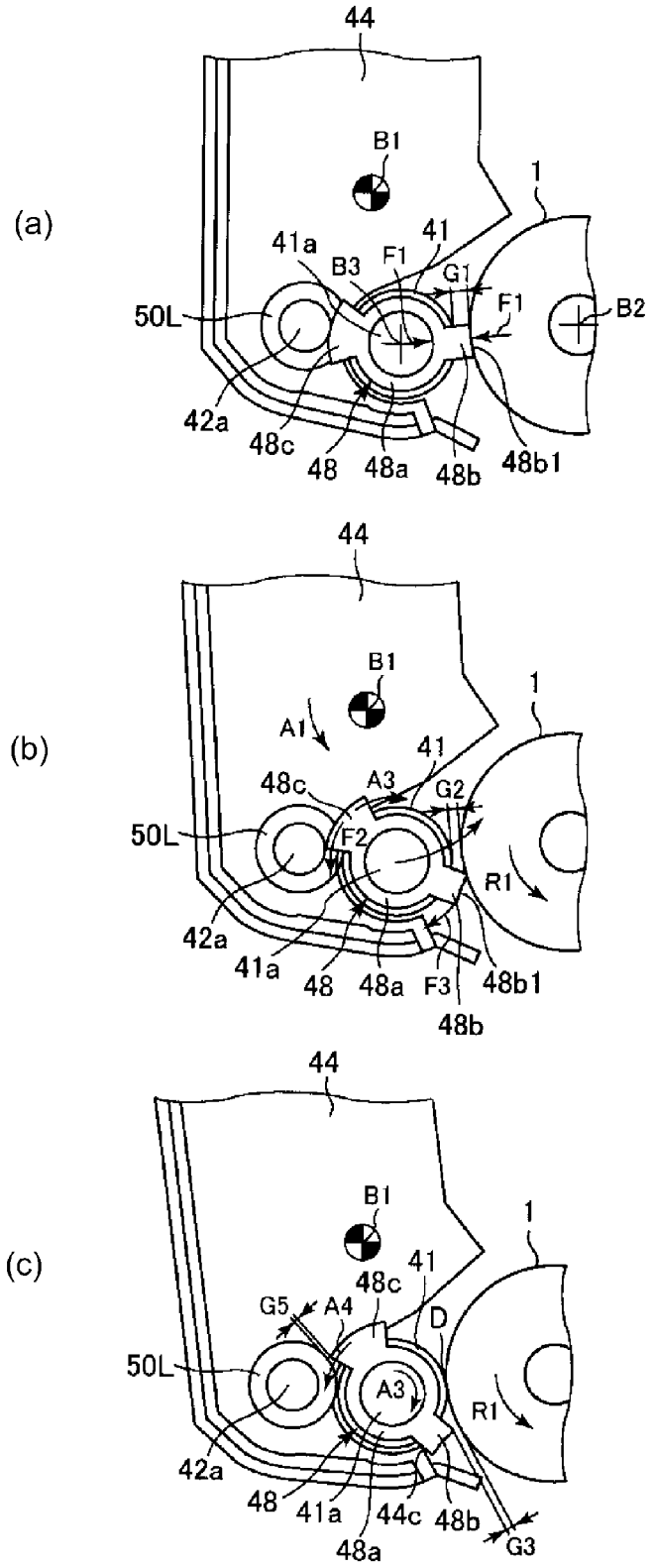
Figure 11:
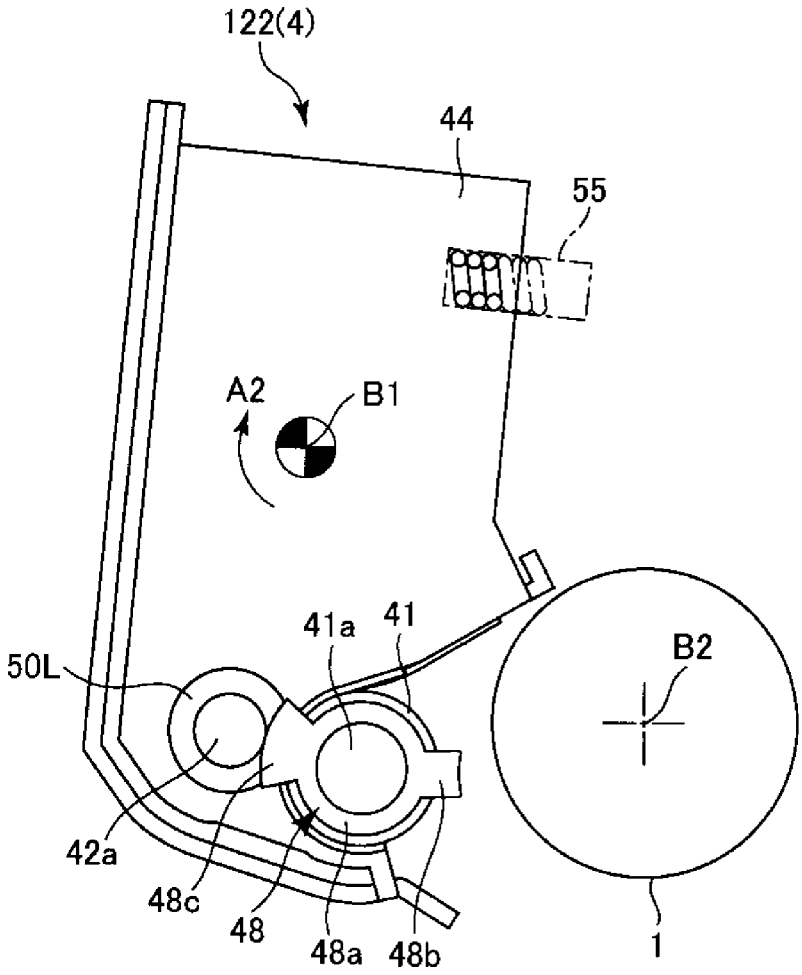

Parts (a) to (c) of FIG. 10 and FIG. 11 are schematic sectional views, of the non-driving side end portion of the developing device and its neighborhood, for illustrating an operation of a spacer member in Embodiment 1.

Figure 12:
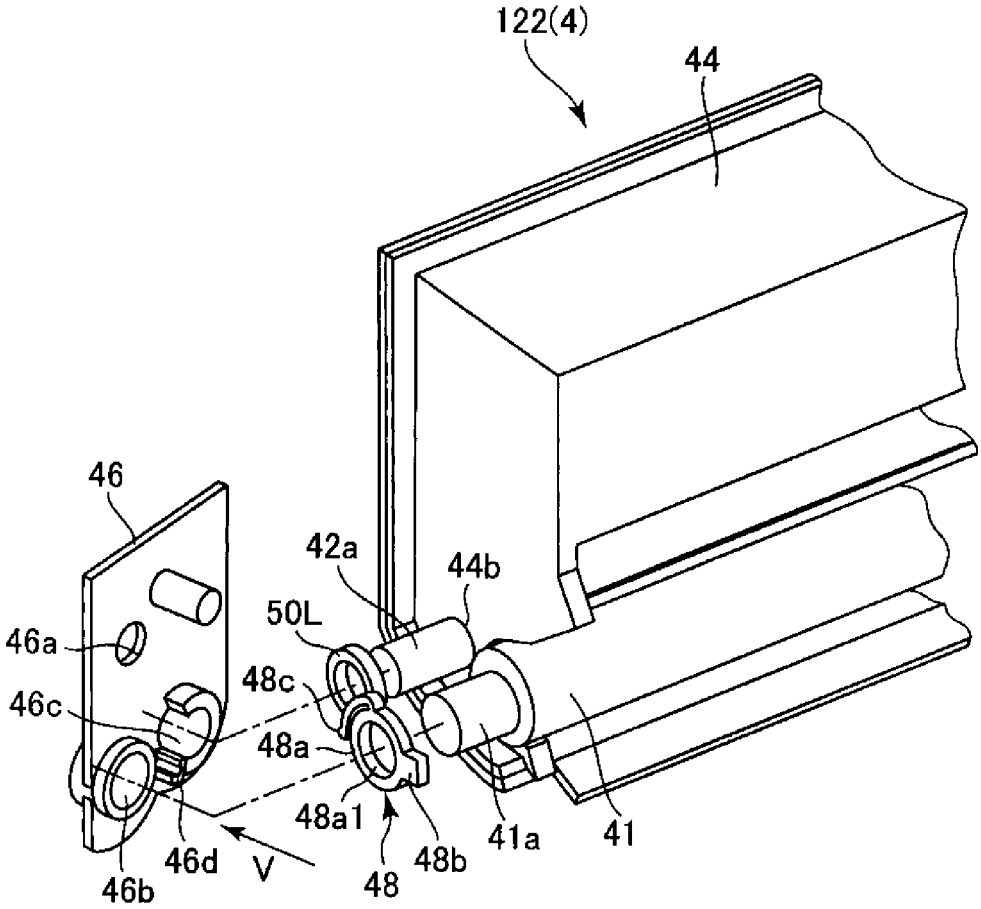

FIG. 12 is an assembling perspective view of a non-driving side end portion of a developing device and its neighborhood in Embodiment 2.

Figure 13:
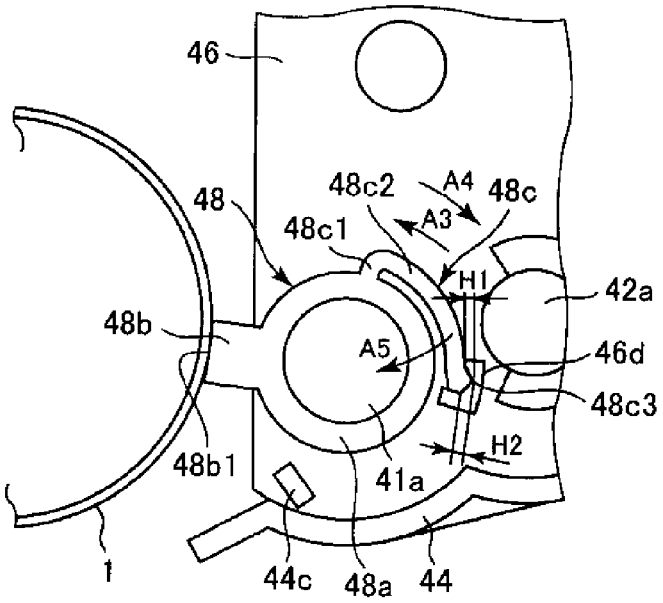
Figure 13:
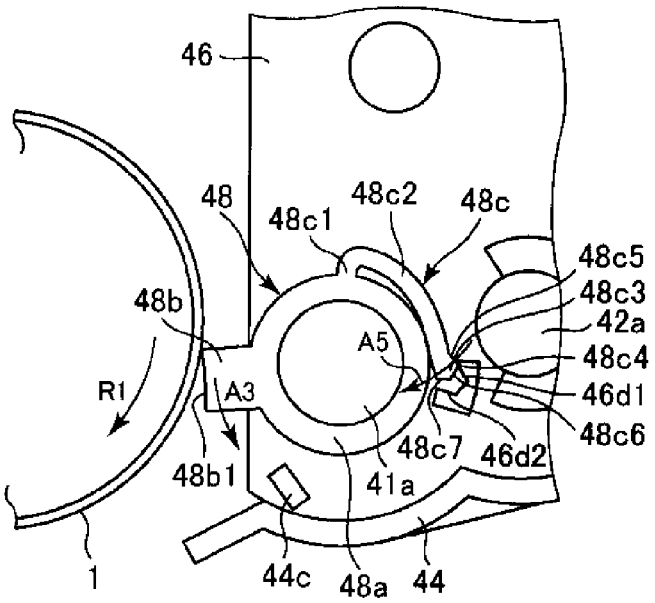
Figure 14:
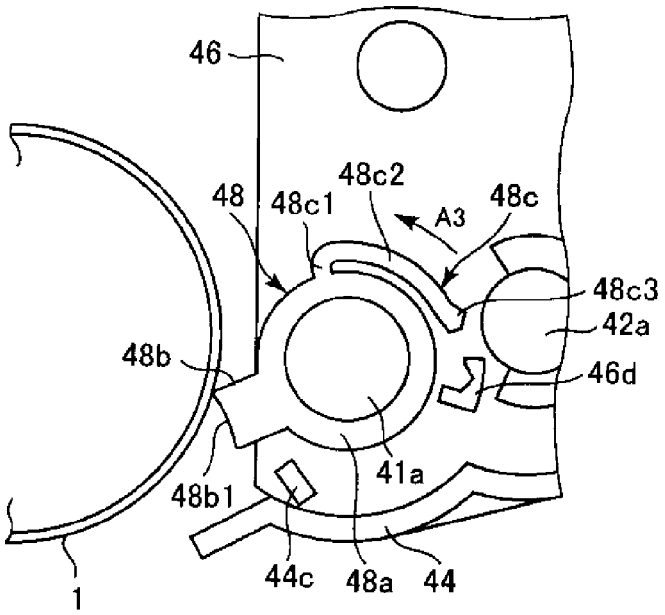
Figure 14:
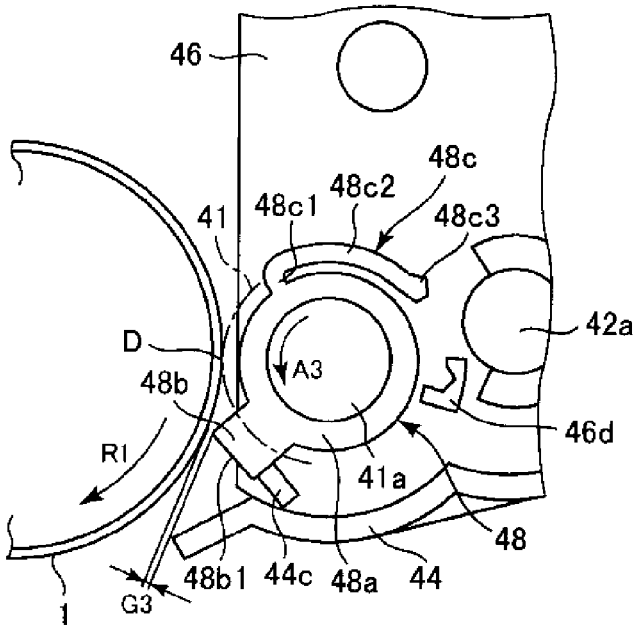

Parts (a) and (b) of FIG. 13 and (a) and (b) of FIG. 14 are schematic sectional views, of the non-driving side end portion of the developing device and its neighborhood, for illustrating an operation of a spacer member in Embodiment 2.

Figure 15:
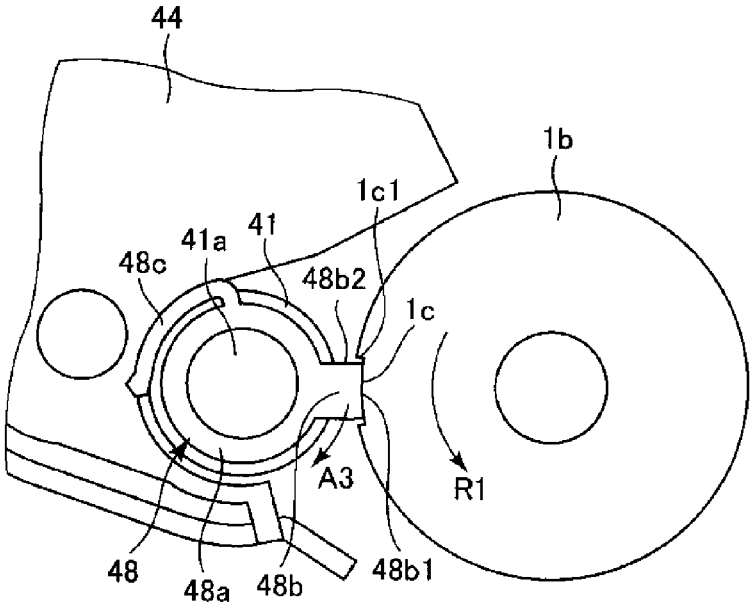

FIG. 15 is a schematic sectional view, of a non-driving side end portion of a developing device and its neighborhood, for illustrating an operation of a spacer member in Embodiment 3.

Figure 16:
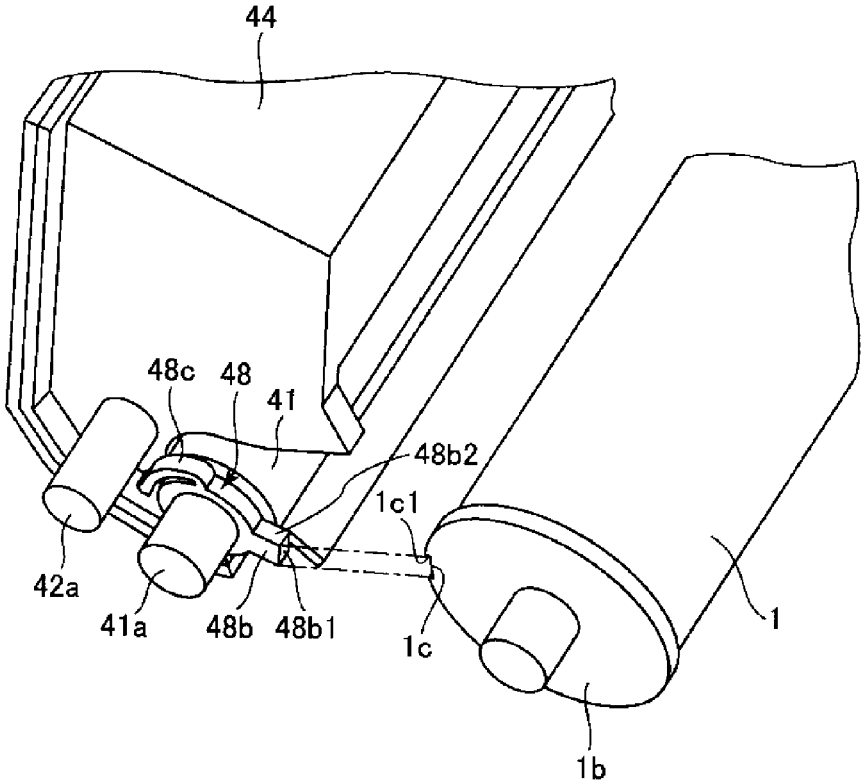

FIG. 16 is an assembling perspective view, of the non-driving side end portion of the developing device and its neighborhood, for illustrating the operation of the spacer member in Embodiment 3.

Figure 17:
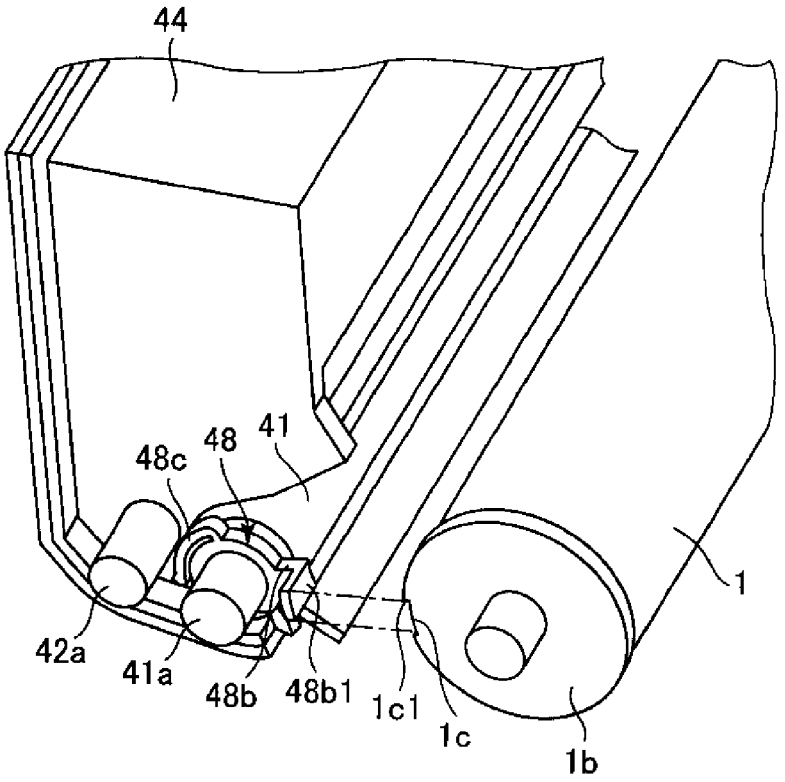
Figure 17:
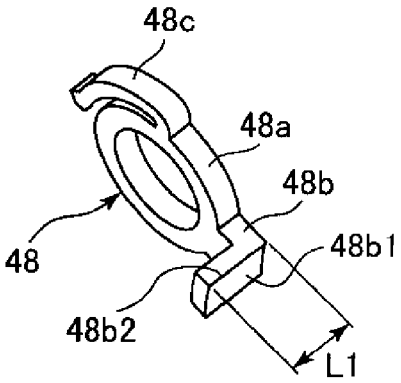

Parts (a) and (b) of FIG. 17 are perspective views for illustrating a modified example of the spacer member in Embodiment 3, in which (a) is an assembling perspective view of the non-driving side end portion of the developing device and its neighborhood and (b) is the perspective view of the spacer member.

Figure 18:
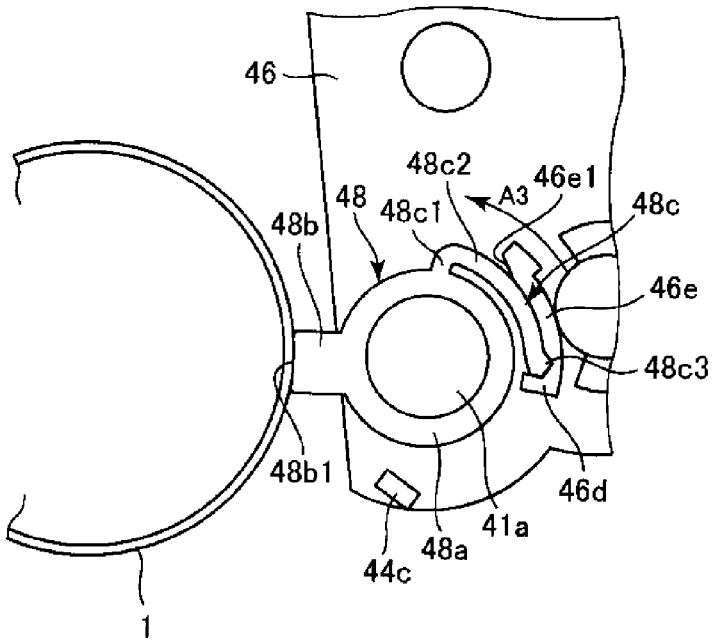
Figure 18:
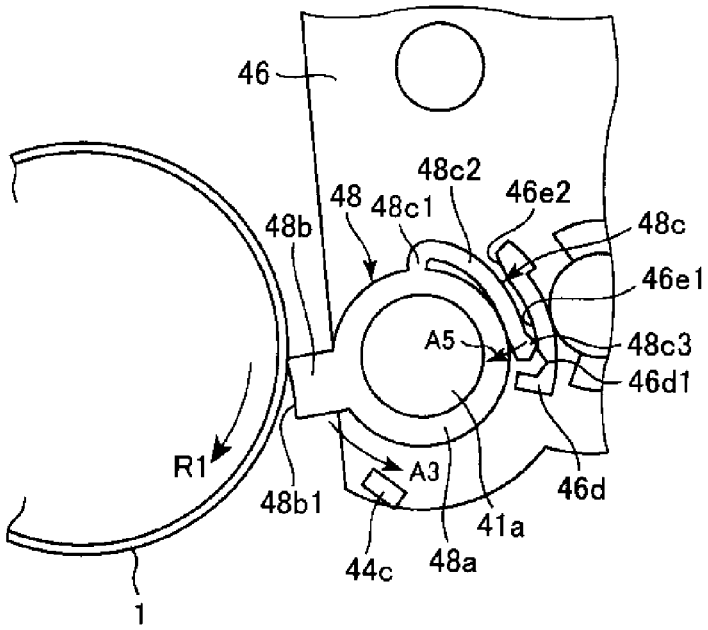
Figure 19:
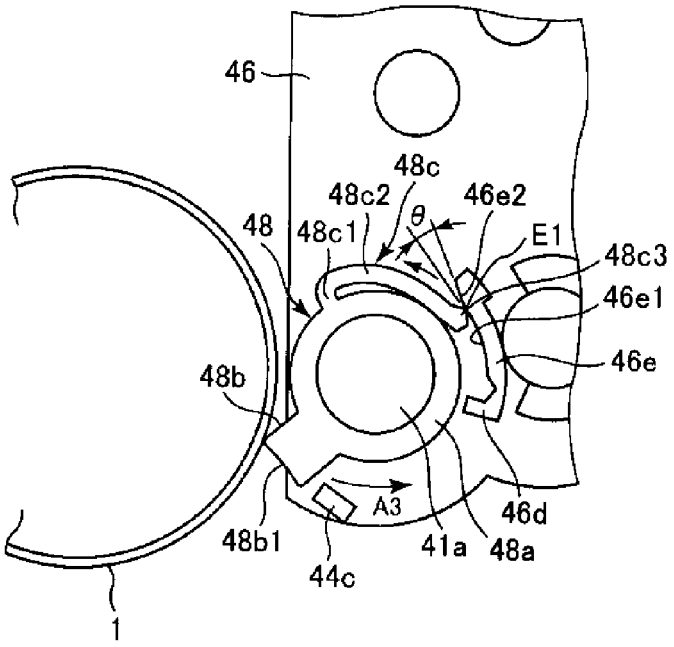
Figure 19:
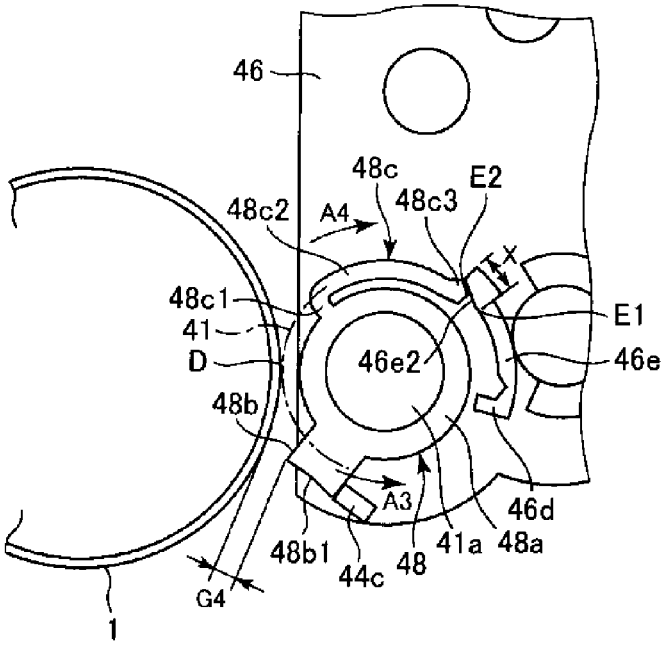

Parts (a) and (b) of FIG. 18 and (a) and (b) of FIG. 19 are schematic sectional views, of a non-driving side end portion of a developing device and its neighborhood, for illustrating an operation of a spacer member in Embodiment 4.

Figure 20:
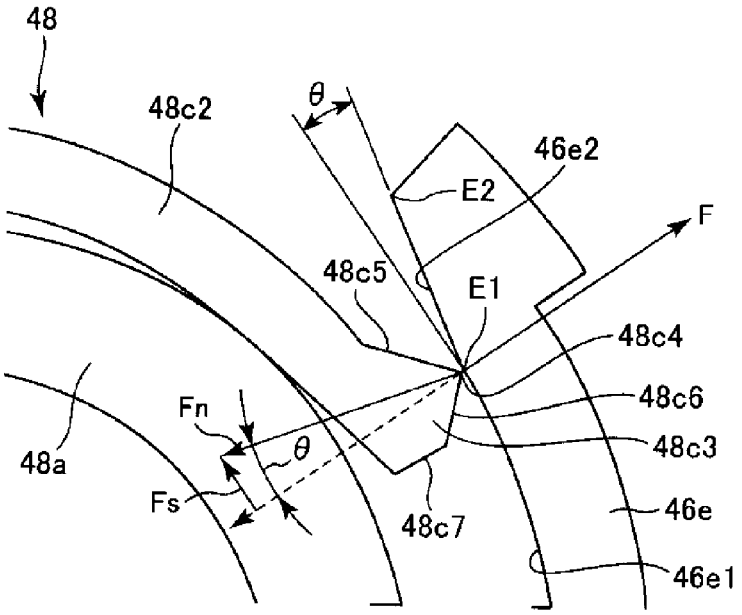

FIG. 20 is an enlarged sectional view for illustrating the operation of the spacer member in Embodiment 4.

Figure 21:
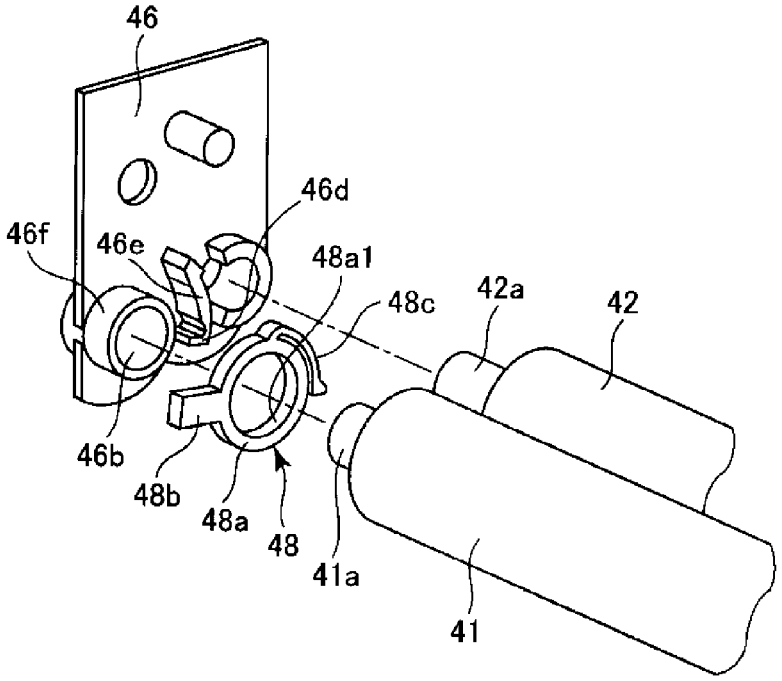

FIG. 21 is an assembling perspective view, of a non-driving side end portion of a developing device and its neighborhood, for illustrating a supporting method of a spacer member in Embodiment 5.

Figure 22:
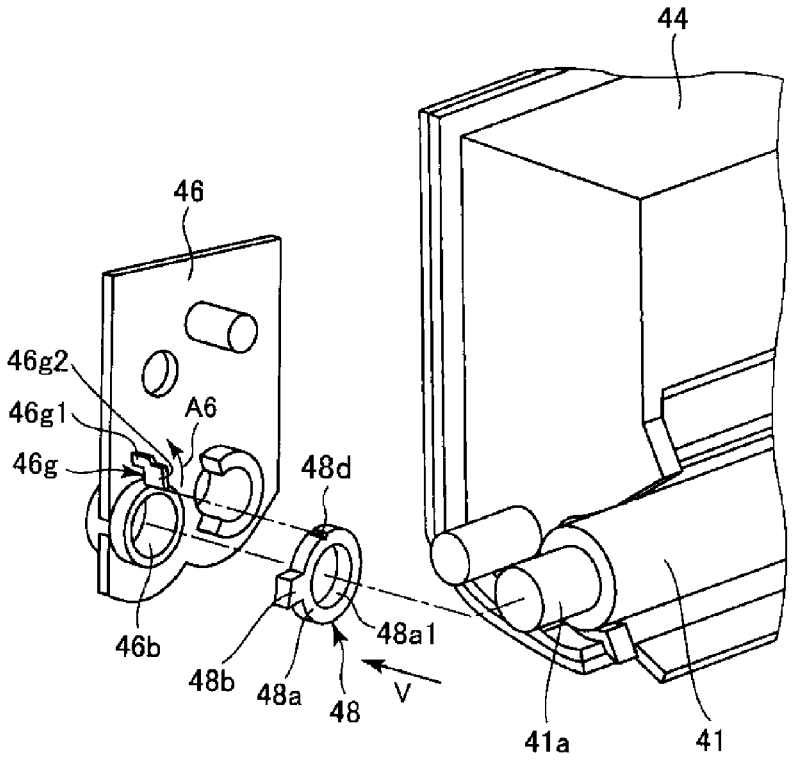

FIG. 22 is an assembling perspective view of a non-driving side end portion of a developing device and its neighborhood in Embodiment 6.

Figure 23:
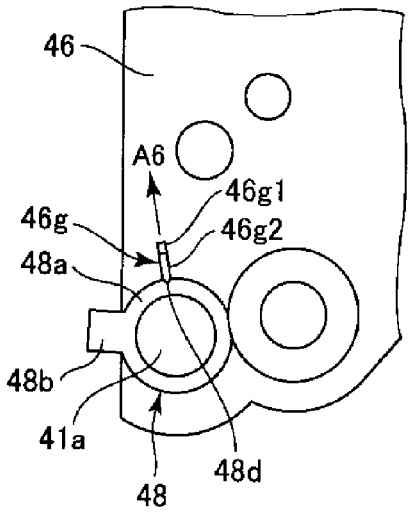

FIG. 23 is a schematic sectional view, of the non-driving side end portion of the developing device and its neighborhood, for illustrating an operation of a spacer member in Embodiment 6.

Figure 24:
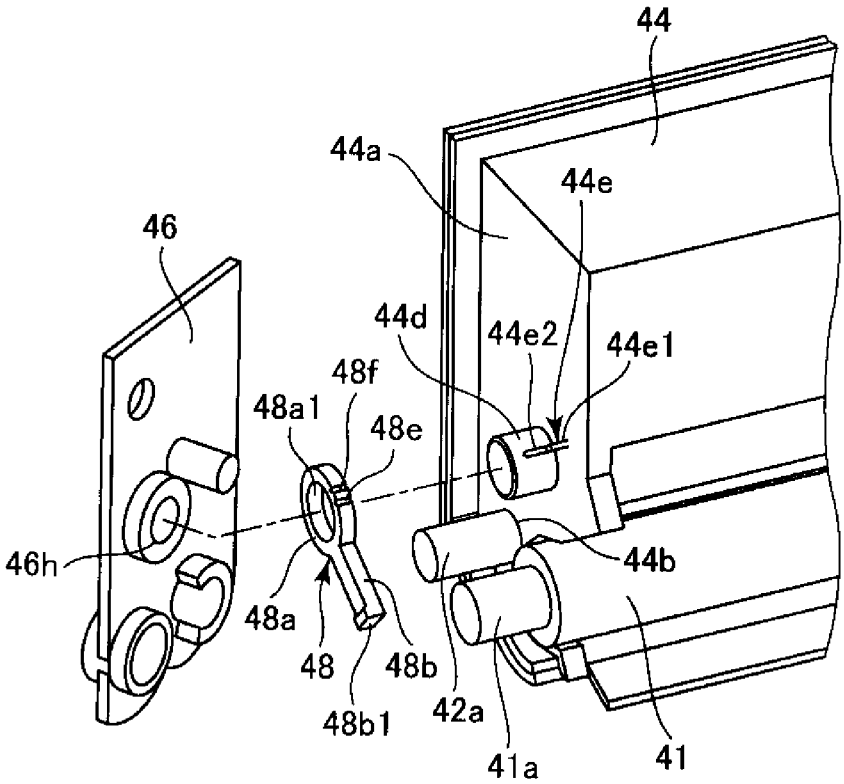

FIG. 24 is an assembling perspective view of a non-driving side end portion of a developing device and its neighborhood in Embodiment 7.

Figure 25:
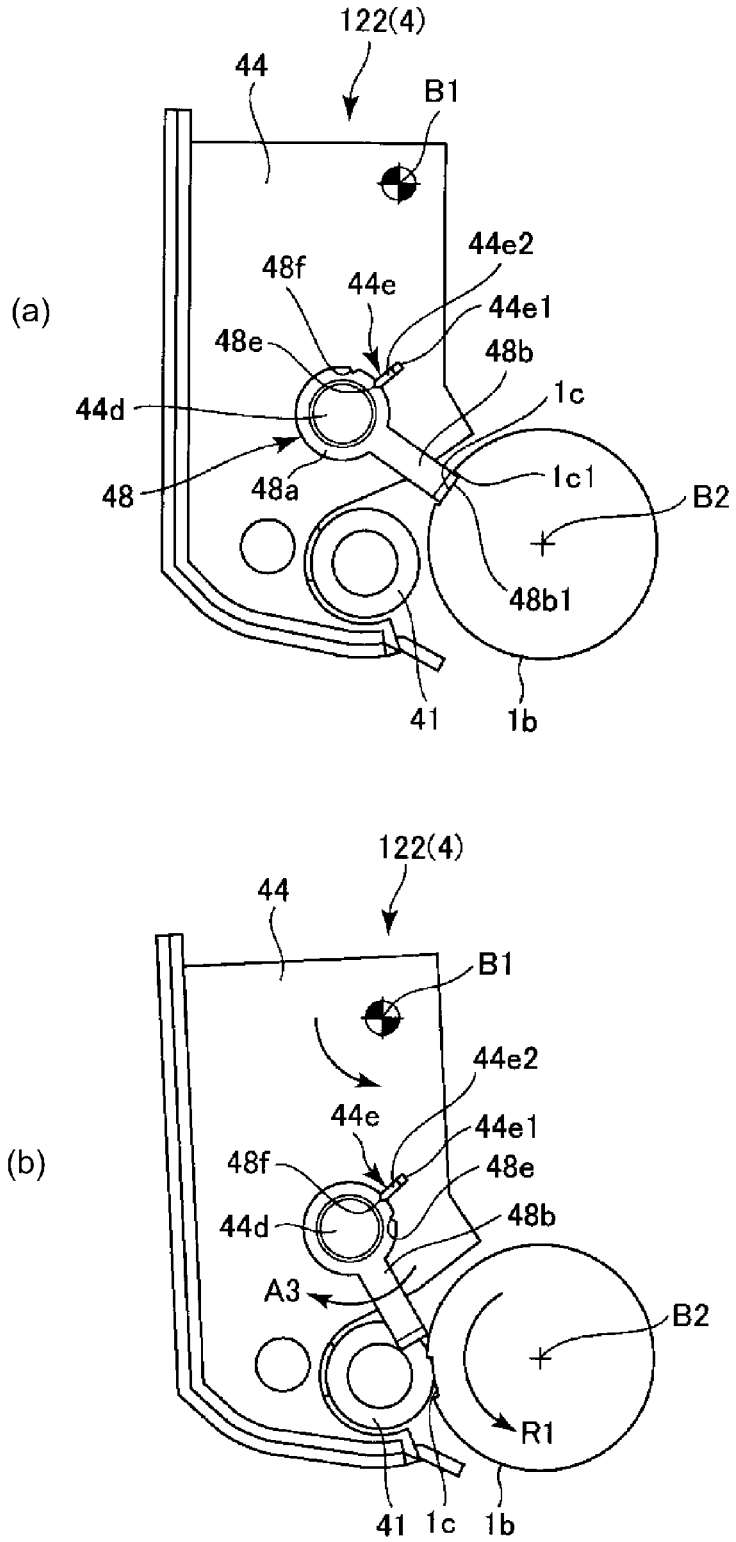

Parts (a) and (b) of FIG. 25 are schematic sectional views, of the non-driving side end portion of the developing device and its neighborhood, for illustrating an operation of a spacer member in Embodiment 7.

Figure 26:
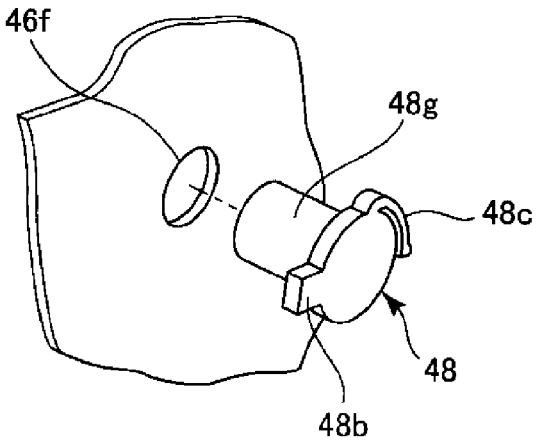

FIG. 26 is a perspective view of, a spacer member, for illustrating a supporting method of a spacer member in another embodiment of the present invention.

Figure 27:
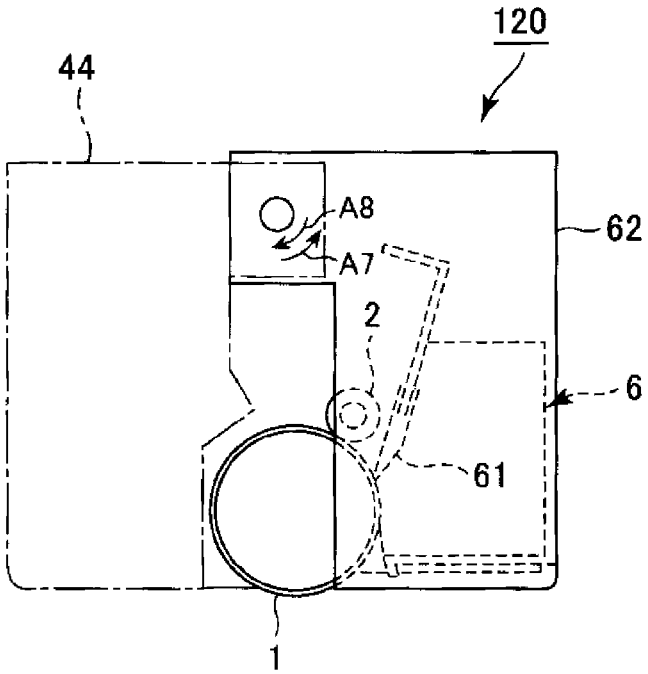

FIG. 27 is a schematic view for illustrating another embodiment of the present invention.

DESCRIPTION OF THE PREFERRED EMBODIMENTS

Hereinbelow, a process unit, a developing device, a process cartridge and an image forming apparatus in the present invention will be specifically described with reference to the drawings.

(Embodiment 1)

1. General Structure and Operation of Image Forming Apparatus

Figure 1:
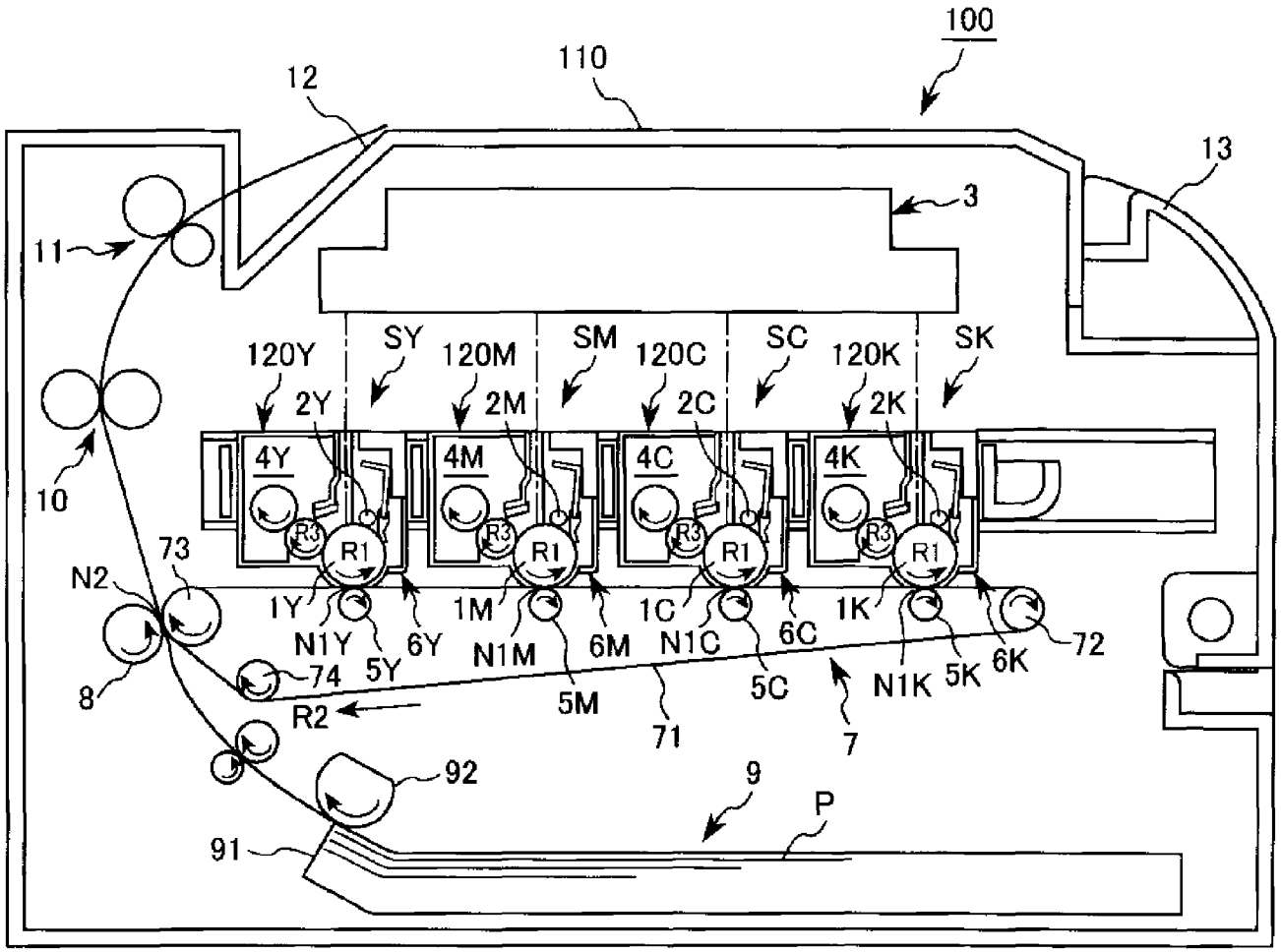
FIG. 1 is a schematic sectional view of an image forming apparatus in Embodiment 1 of the present invention.

First, a general structure and operation of an image forming apparatus 100 according to this embodiment of the present invention will be described. FIG. 1 is a schematic sectional view of the image forming apparatus 100 in this embodiment.

The image forming apparatus 100 in this embodiment is a laser beam printer capable of forming a full-color image on a recording material (toner image-receiving material) P such as paper by using an electrophotographic process.

The image forming apparatus 100 in this embodiment includes first to fourth image forming portions (stations) SY, SM, SC and SK as a plurality of image forming portions. The first to fourth image forming portions form images of yellow (Y), magenta (M), cyan (C) and black (K), respectively.

In this embodiment, constitutions and operations of the first to fourth image forming portions SY, SM, SC and SK are substantially the same except that the colors of toners as developers used are different from each other. Therefore, in the following, in the case where there is no need to particularly discriminate the image forming portions, suffixes, Y, M, C and K added for representing elements or portions for associated color image forming portions are omitted, and the elements or portions will be collectively described.

Here, with respect to the image forming apparatus 100, a side where a right-side apparatuses openable door 13 in FIG. 1 is provided is referred to as a front surface (side), and a side opposite from the front surface (side) is referred to as a rear surface (side) (or a back surface (side)). Further, when the image forming apparatus 100 is viewed from the front surface side, a right side is referred to as a driving side, and a left side is referred to as a non-driving side.

In the image forming apparatus 100 in this embodiment, a process cartridge type is employed, and by detachably (removably) mounting a process cartridge 120 in a main assembly (apparatus main assembly) 110 of the image forming apparatus 100, an image can be formed on the recording material P.

In the apparatus main assembly 110, the first, second, third and fourth process cartridges 120Y, 120M, 120C and 120K are provided and arranged in a substantially horizontal direction. Each of the first, second, third and fourth process cartridges 120Y, 120M, 120C and 120K includes the same electrophotographic process mechanism but accommodates the toner, as the developer, having a different color.

To the process cartridge 120, a rotational driving force is transmitted from a drive output portion (not shown) of the apparatus main assembly 110. Further, to the process cartridge 120, a bias voltage (charging bias, developing bias or the like) is supplied from a bias power source (not shown) of the apparatus main assembly 110.

Figure 2:
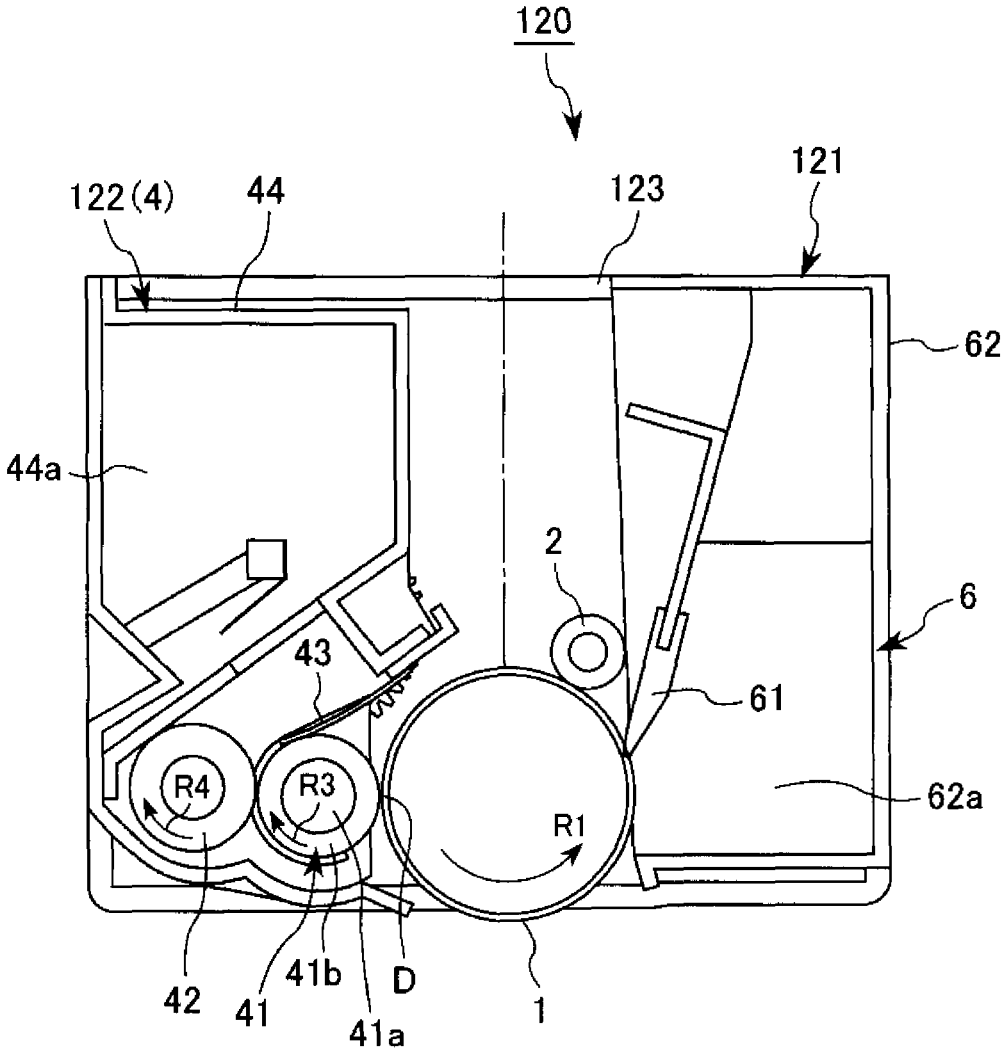
FIGS. 2 and 3 are schematic sectional views of a process cartridge in Embodiment 1.

FIG. 2 is a schematic sectional view of the process cartridge 120 of the image forming apparatus 100 in this embodiment. The process cartridge 120 in this embodiment includes a drum-type electrophotographic photosensitive member as an image bearing member, i.e., a photosensitive drum 1 and a process member actable on the photosensitive drum 1. In this embodiment, the photosensitive drum 1 is an organic photosensitive drum having an organic photoconductor (OPC) photosensitive layer. Further, in this embodiment, the process cartridge 120 includes, as the process member, a charging means, a developing means and a cleaning means.

In this embodiment, the process cartridge 120 includes a charging roller 2 which is a roller-type charging member as the charging means. The process cartridge 120 further includes a drum cleaner 6 provided with a cleaning blade 61 as the cleaning means, and includes a developing device 4 provided with a developing roller 41 which is a roller-type developer carrying member as the developing means. The developing device 4 further includes a supplying roller 42 as a developer supplying member, a developing blade 43 as a developer regulating member, and the like. A specific structure of the process cartridge 120 will be described later.

The first process cartridge 120Y accommodates the toner of yellow (Y) in a developing device frame 44 and forms a toner image of yellow on the surface of the photosensitive drum 1. The second process cartridge 120M accommodates the toner of magenta (M) in a developing device frame 44 and forms a toner image of magenta on the surface of the photosensitive drum 1. The third process cartridge 120C accommodates the toner of cyan (C) in a developing device frame 44 and forms a toner image of cyan on the surface of the photosensitive drum 1. The fourth process cartridge 120K accommodates the toner of black (K) in a developing device frame 44 and forms a toner image of black on the surface of the photosensitive drum 1.

In the apparatus main assembly 100, above the first to fourth process cartridges 120Y, 120M, 120C and 120K, a laser scanner unit 3 as an exposure means is provided. The laser scanner unit 3 outputs laser light corresponding to image information. Then the laser light passes through an exposure window 123 of the process cartridge 120 and scans and exposes the surface of the photosensitive drum 1.

Further, at an opposing position to the first to fourth process cartridges 120Y, 120M, 120C and 120K (under the respective process cartridges in this embodiment), an intermediary transfer unit 7 is provided. The intermediary transfer unit 7 includes a flexible endless belt-like intermediary transfer belt 71 as an intermediary transfer member. The intermediary transfer belt 71 is extended around a driving roller 72, a turn roller 73 and a tension roller 74 which are used as a plurality of supporting rollers. The photosensitive drum 1 of the process cartridge 120 is contacted to the intermediary transfer belt 71. A contact portion between the photosensitive drum 1 and the intermediary transfer belt 71 is a primary transfer portion N1.

In an inner peripheral surface side of the intermediary transfer belt 71, a primary transfer roller 5 which is a roller-type transfer member as a primary transfer means is provided opposed to the photosensitive drum 1. The primary transfer roller 5 is contacted to the intermediary transfer belt 71 toward the photosensitive drum 1.

A secondary transfer roller 8 which is a roller-type transfer member as a secondary transfer means is contacted to the intermediary transfer belt 71 toward the turn roller 73. A contact portion between the intermediary transfer belt 71 and the secondary transfer roller 8 is a secondary transfer portion N2.

In an upstream side of the secondary transfer portion N2 with respect to a conveyance direction of the recording material P (below the intermediary transfer unit 7 in this embodiment), a (sheet) feeding unit 9 is provided. The feeding unit 9 includes a sheet feeding tray 91 in which sheets of the recording material P are stacked and accommodated, and includes a sheet feeding roller 92, and the like.

Further, in a downstream side of the secondary transfer portion N2 with respect to the conveyance direction of the recording material P (above the secondary transfer portion N2 in a rear surface side in the apparatus main assembly 10 in this embodiment), a fixing unit 10 as a fixing means and a discharging unit 11 are provided. An upper surface of the apparatus main assembly 110 constitutes a (sheet) discharge tray 12.

2. Image Forming Operation

As an example of an image forming operation, an operation for forming a full-color image will be described.

The photosensitive drum 1 of each process cartridge 120 is rotationally driven in an arrow R1 direction in FIGS. 1 and 2 at a predetermined speed (peripheral speed). At this time, also the intermediary transfer belt 71 is rotationally driven in an arrow R2 direction in FIG. 1 at a speed (peripheral speed) corresponding to the speed (peripheral speed) of the photosensitive drum 1 so that a movement direction of the surface of the intermediary transfer belt 71 is the same as that of the surface of the photosensitive drum 1 at the primary transfer portion N1.

Next, the laser scanner unit 3 is driven. In synchronism with the drive of the laser scanner unit 3, in each process cartridge 120, the charging roller 2 uniformly charges the surface of the photosensitive drum 1 to predetermined polarity and potential. Then, the laser scanner unit 3 subjects the surface of the photosensitive drum 1 to scanning exposure to the laser light depending on an image signal of an associated color. As a result, an electrostatic latent image (electrostatic image) depending on the image signal of the associated (corresponding) color is formed on the surface of the photosensitive drum 1.

The electrostatic latent image formed on the photosensitive drum 1 is supplied with the associated (color) toner by the developing roller 41, of the developing device 4, rotationally driven in an arrow R3 direction in FIGS. 1 and 2 at a predetermined speed (peripheral speed), thus being developed as a toner image.

By the above-described electrophotographic image forming process, on the photosensitive drum 1 of the first process cartridge 120Y, a yellow toner image corresponding to a yellow component of the full-color image is formed. Then, the toner image is primary-transferred onto the intermediary transfer belt 71 by the action of the primary transfer roller 5. Similarly, on the photosensitive drum 1 of the second process cartridge 120M, a magenta toner image corresponding to a magenta component of the full-color image is formed. Then, the toner image is primary-transferred superposedly onto the yellow toner image which has already been formed on the intermediary transfer belt 71. Similarly, on the photosensitive drum 1 of the third process cartridge 120C, a cyan toner image corresponding to a cyan component of the full-color image is formed. Then, the toner image is primary-transferred superposedly onto the yellow and magenta toner images which have already been formed on the intermediary transfer belt 71. Similarly, on the photosensitive drum 1 of the fourth process cartridge 120K, a black toner image corresponding to a black component of the full-color image is formed. Then, the toner image is primary-transferred superposedly onto the yellow, magenta and cyan toner images which have already been formed on the intermediary transfer belt 71.

In this way, unfixed toner images for the full-color image consisting of the toner images of the four colors of yellow, magenta, cyan and black are formed on the intermediary transfer belt 71.

On the other hand, in the feeding unit 9, the sheets of the recording material P are separated and fed one by one with predetermined control timing. The recording material P introduced into the secondary transfer portion N2, with predetermined control timing, which is the contact portion between the secondary transfer roller 8 and the intermediary transfer belt 71.

As a result, in a process in which the recording material P is conveyed through the secondary transfer portion N2, the superposed four color toner images on the intermediary transfer belt 71 are successively secondary-transferred collectively onto the surface of the recording material P.

Thereafter, the recording material P on which the unfixed toner images are carried is conveyed to the fixing unit 10 and then is, after the toner images are fixed thereon by the fixing unit 10, discharged onto the discharge tray 12.

Incidentally, the toner remaining on the photosensitive drum 1 after the primary transfer step (primary transfer residual toner) is removed and collected from the surface of the photosensitive drum 1 by the drum cleaner 6. Further, the toner remaining on the intermediary transfer belt 71 after the secondary transfer step (secondary transfer residual toner) is removed and collected from the surface of the intermediary transfer belt 71 by a belt cleaner (not shown) as an intermediary transfer member cleaning means.

3. Structure of Process Cartridge

Figure 3:
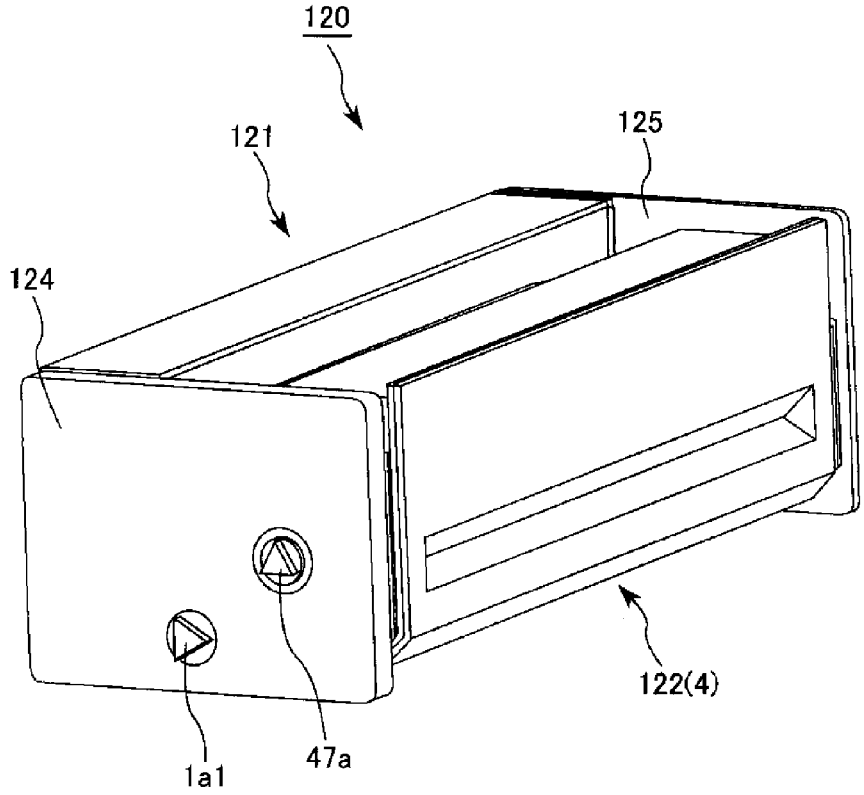

FIG. 3 is a perspective view of the process cartridge 120. The process cartridge 120 has an elongated shape extending in a longitudinal direction in parallel to a rotational axis direction of the photosensitive drum 1. The process cartridge 120 is provided so that one longitudinal end portion thereof is disposed in a driving side and another longitudinal end portion thereof is disposed in a non-driving side in a state in which the process cartridge 120 is mounted in the apparatus main assembly 110.

The process cartridge 120 includes a cleaning unit 121, a developing unit 122 (developing device 4), a driving side cover member 124 and a non-driving side cover member 125. The cleaning unit 121 and the developing unit 122 are connected with each other.

The cleaning unit 121 includes the photosensitive drum 1, the charging roller 2 and the drum cleaner 6. The drum cleaner 6 includes the cleaning blade 61. The photosensitive drum 1, the charging roller 2 and the cleaning blade 61 are mounted to a cleaning container (cleaning device frame) 62 as a frame for forming a residual toner accommodating portion 62*a*.

The charging roller 2 contacts the surface of the photosensitive drum 1 and is rotated by the rotation of the photosensitive drum 1. Then, the charging roller 2 is supplied with the charging bias, thus charging the surface of the photosensitive drum 1.

The cleaning blade 61 is fixed in the cleaning container 62. The cleaning blade 61 is contacted to the photosensitive drum 1 counterdirectionally to the rotational direction of the photosensitive drum 1 at its elastic rubber end portion (widthwise free end portion). The cleaning blade 61 removes (scrapes), during image formation, the transfer residual toner remaining on the rotating photosensitive drum 1 to clean the surface of the photosensitive drum 1. An end of the cleaning blade 61 is contacted to the surface of the photosensitive drum 1 under predetermined pressure in order to remove the transfer residual toner with high reliability.

The transfer residual toner removed from the surface of the photosensitive drum 1 by the cleaning blade 61 is accommodated, as waste toner, in the residual toner accommodating portion 62*a* formed inside the cleaning container 62.

4. Structure of Developing Device

Figure 4:
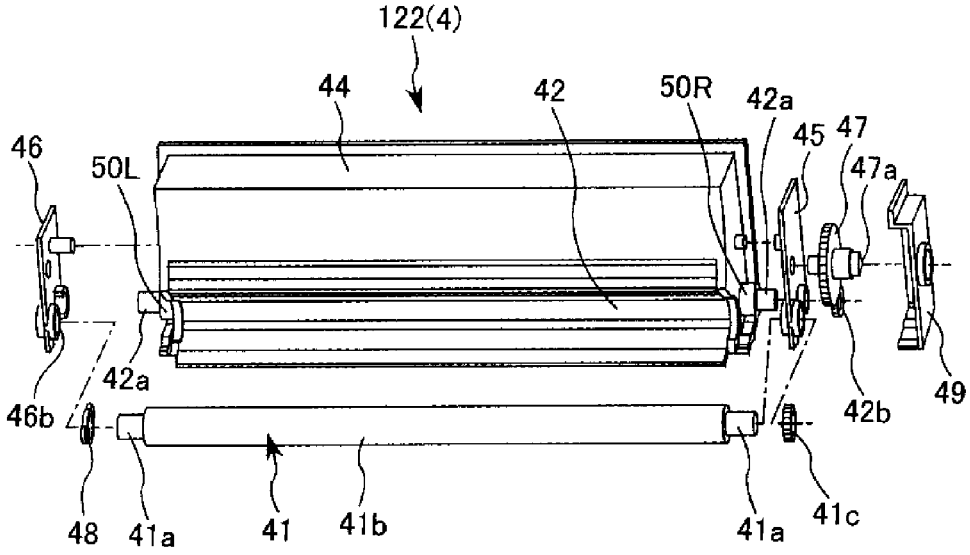
FIG. 4 is an assembling perspective view of a developing device in Embodiment 1.

FIG. 4 is an assembling perspective view of the developing device 4. The developing unit 122 (developing device 4) has an elongated shape extending in a longitudinal direction in parallel to a rotational axis direction of the developing roller 51 as a developer carrying member. The developing device 4 is provided so that one longitudinal end portion thereof is disposed in the driving side and another longitudinal end portion thereof is disposed in the non-driving side in a state in which the developing device 4 is disposed in the apparatus main assembly 110.

The developing roller 41 and the supplying roller 42 are mounted to the developing device frame 44 as a frame for forming a toner accommodating portion 44*a*. A rotation shaft (core material) 41*a* of the developing roller 41 is rotatably supported at its end portions by a driving side bearing member 45 and a non-driving side bearing member 46, as a supporting frame, mounted to a driving side end portion and a non-driving side end portion, respectively, of the developing device frame 44. Similarly, a rotation shaft (core material) 42*a* of the supplying roller 42 is rotatably supported at its end portions by the driving side bearing member 45 and the non-driving side bearing member 46, respectively. The driving side bearing member 45 and the non-driving side bearing member 46 are integrally fixed to the developing device frame 44.

In this embodiment, the developing roller 41 is constituted by forming an elastic layer 41*b* having a proper electroconductivity around the core material (core metal) 41*a* of metal such as stainless steel. The elastic layer 41*b* is formed of a rubber material. As the rubber material, it is possible to use silicone rubber, urethane rubber, acrylic rubber, natural rubber, EPDM (ethylene-propylene-diene-rubber), and the like. An electric resistance value can be adjusted by dispersing carbon black, carbon resin particles, metal particles, ion-conductive agent, and the like.

Further, outside the driving side bearing member 45 with respect to the longitudinal direction of the developing device 4, a developing roller gear 41*c* is mounted to the driving side end portion of the core material 41*a* of the developing roller 41. Similarly, outside the driving side bearing member 45 with respect to the longitudinal direction of the developing device 4, a supplying roller gear 42*b* is mounted to the driving side end portion of the core material 42*a* of the supplying roller 42. These developing roller gear 41*c* and supplying roller gear 42*b* are engaged with a developing device drive inputting gear 47 rotatably supported by the driving side bearing member 45.

The developing device drive inputting gear 47 includes a drive inputting coupling 47*a*. The drive inputting gear 47*a* is engaged with a drive outputting coupling (not shown) of the apparatus main assembly 110 side, so that a driving force of a driving motor (not shown) of the apparatus main assembly 110 is transmitted to the developing device drive inputting gear 47. As a result, the developing roller 41 and the supplying roller 42 are rotationally driven at a predetermined speed via the developing roller gear 41*c* and the supplying roller gear 42*b*, respectively. The developing roller 41 is rotationally driven in the arrow R3 direction in FIG. 2, and the supplying roller 42 is rotationally driven in the arrow R4 direction in FIG. 2. The developing roller 41 and the supplying roller 42 are contacted, and at a contact portion thereof, their surface movement directions are opposite to each other.

To the non-driving side end portion of the core material 41*a* of the developing roller 41, a spacer member 48 as a regulating member for placing the photosensitive member and the process member in a more spaced state than during use is mounted. The spacer member 48 is rotatably supported by the core material 41*a*. Further, from the outside of the spacer member 48 with respect to the longitudinal direction of the developing device 4, the non-driving side bearing member 46 is mounted. Details of the spacer member 48 will be described later.

The developing blade 43 is an about 0.1 mm-thick thin metal plate. An end (widthwise free end) of the developing blade 43 is contacted to the developing roller 41 counterdirectionally to the rotational direction of the developing roller 41.

Further, at the driving side end portion of the developing device 4 with respect to the longitudinal direction, a driving side supplying roller shaft seal 50R as a seal member (hereinafter referred to as a "driving side seal" 50R) is mounted to a portion, of the core material 42*a* of the supplying roller 42, exposed outside the developing device frame 44.

Further, at the non-driving side end portion of the developing device 4 with respect to the longitudinal direction, a non-driving side supplying roller shaft seal 50R as a seal member (hereinafter referred to as a "non-driving side seal" 50L) is mounted to a portion, of the core material 42*a* of the supplying roller 42, exposed outside the developing device frame 44. As a result, toner leakage from a gap between a through hole 44*b* (FIG. 8) provided in the developing device frame 44 and the core material 42*a* is prevented.

The developing device 4 is always urged, about a swing center B1 (FIG. 7), in a direction (arrow A1 direction in FIG. 7) in which the developing roller 41 is contacted to the photosensitive drum 1 by an urging spring 55 (FIGS. 9 and 11) as an urging means. The urging spring 55 is provided between the cleaning container 62 and the developing device frame 44 and rotationally moves the developing device frame 44 relative to the cleaning container 62. By an urging force of the urging spring 55, the developing roller 41 is contacted to the photosensitive drum 1.

During image formation, the developing roller and the supplying roller 42 are driven as described above, so that the supplying roller 42 and the developing roller 41 slide with each other while being rotated. As a result, the toner inside the developing device frame 44 is carried on the developing roller 41.

The developing blade 43 regulates a thickness of a toner layer formed on a peripheral surface of the developing roller 41, and at the same time, imparts electric charges to the toner by triboelectric charge between itself and the developing roller 41.

Then, at a contact portion D between the developing roller 41 and the photosensitive drum 1, the charged toner on the developing roller 41 is deposited on the electrostatic latent image on the photosensitive drum 1. As a result, the electrostatic latent image on the photosensitive drum 1 is developed as the toner image.

5. Connecting Method of Cleaning Unit and Developing Device

Figure 5:
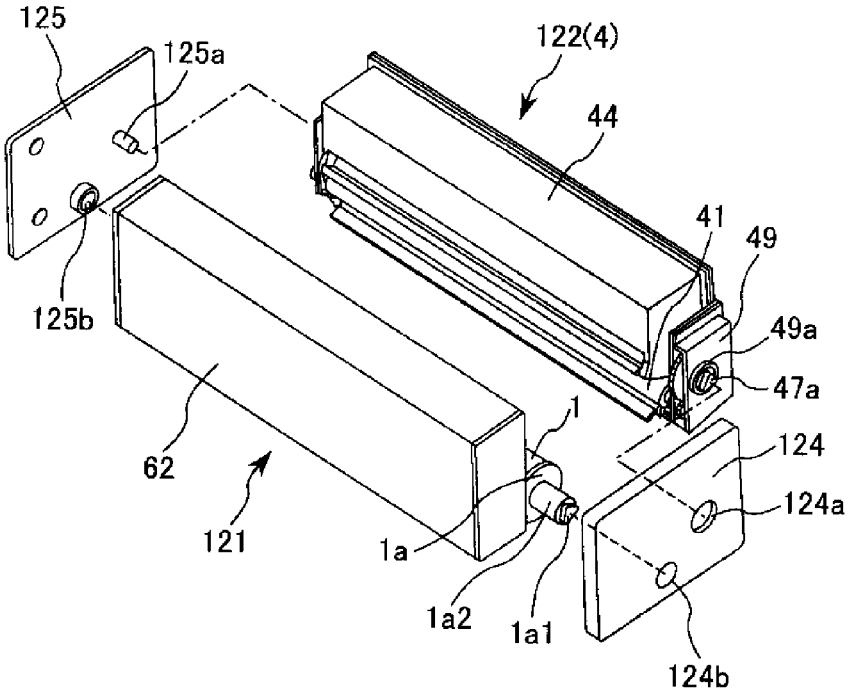
FIGS. 5 and 6 are assembling perspective views of the process cartridge in Embodiment 1.
Figure 6:
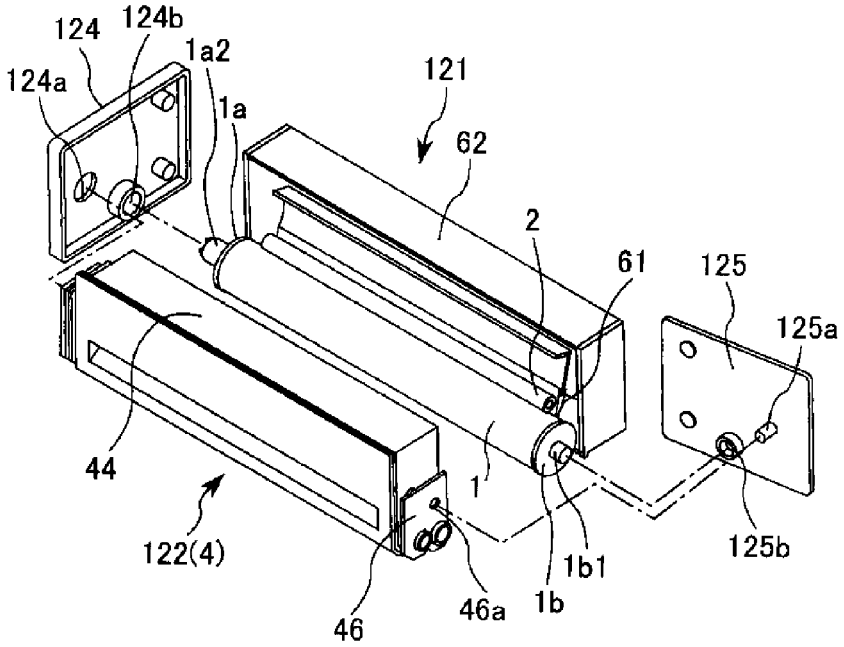

FIGS. 5 and 6 are assembling perspective views for illustrating a connecting method of the cleaning unit 121 and the developing unit 122 (developing device 4). FIG. 5 is the respective view as seen from the driving side of the process cartridge 120 with respect to the longitudinal direction, and FIG. 6 is the perspective view as seen from the non-driving side of the process cartridge 120 with respect to the longitudinal direction. To the driving side end portion of the photosensitive drum 1 with respect to the longitudinal direction, a driving side end portion member 1*a* is mounted. To the driving side end portion member 1*a*, a drive inputting coupling 1*a*1 and a shaft portion 1*a*2 are provided. The drive inputting coupling 1*a*1 is engaged with the drive outputting coupling (not shown) in the apparatus main assembly 110 side to receive a driving force of the driving motor (not shown) of the apparatus main assembly 110. Further, to the non-driving side end portion of the photosensitive drum 1 with respect to the longitudinal direction, a non-driving side end portion member 1*b* is mounted. To the non-driving side end portion member 1*b* a shaft portion 1*b*1 is provided.

The driving side cover member 124 rotatably supports the shaft portion 1*a*1 of the driving side end portion member 1*a* by a driving side photosensitive drum bearing portion 124*b*. The non-driving side cover member 125 rotatably supports the shaft portion 1*b*1 of the non-driving side end portion member 1*b* by a non-driving side photosensitive drum bearing portion 125*b*. Further, the driving side cover member 124 and the non-driving side cover member 125 are fixed to the cleaning container 62.

At the driving side end portion of the developing device 4 with respect to the longitudinal direction, a gear holding member 49 integrally fixed to the developing device frame 44 are provided. The gear holding member 49 is integrally fixed to the developing device frame 44 together with the driving side bearing member 45 as a supporting frame for the developing roller 41 and the supplying roller 42. Further, at the non-driving side end portion of the developing device 4 with respect to the longitudinal direction, the non-driving side bearing member 46 as a supporting frame for the developing roller 41 and the supplying roller 42 is integrally fixed to the developing device frame 44.

The gear holding member 49 rotatably supports, together with the driving side bearing member 45, the developing device drive inputting gear 47 including the drive inputting coupling 47*a* for receiving the driving force from the apparatus main assembly 110 to the developing device 4. At an outer side surface of the gear holding member 49 with respect to the longitudinal direction of the developing device 4, a cylindrical swing supporting shaft 49*a* is provided. The swing supporting shaft 49*a* is engaged with a swing supporting hole 124*a* provided in the driving side cover member 124, so that the gear holding member 49 is rotatably supported by the driving side cover member 124.

At an outer side surface of the non-driving side bearing member 46 with respect to the longitudinal direction of the developing device 4, a cylindrical swing supporting hole 46*a* is provided. The swing supporting hole 46*a* is engaged with a swing supporting shaft 125*a* of the non-driving side cover member 125, so that the non-driving side bearing member 46 is rotatably supported by the driving side cover member 124.

Thus, the developing device 4 is swingably supported by the driving side cover member 124 and the non-driving side cover member 125. A distance between the developing roller 41 and the photosensitive drum 1 can be changed by the swing of the developing device 4.

Figure 7:
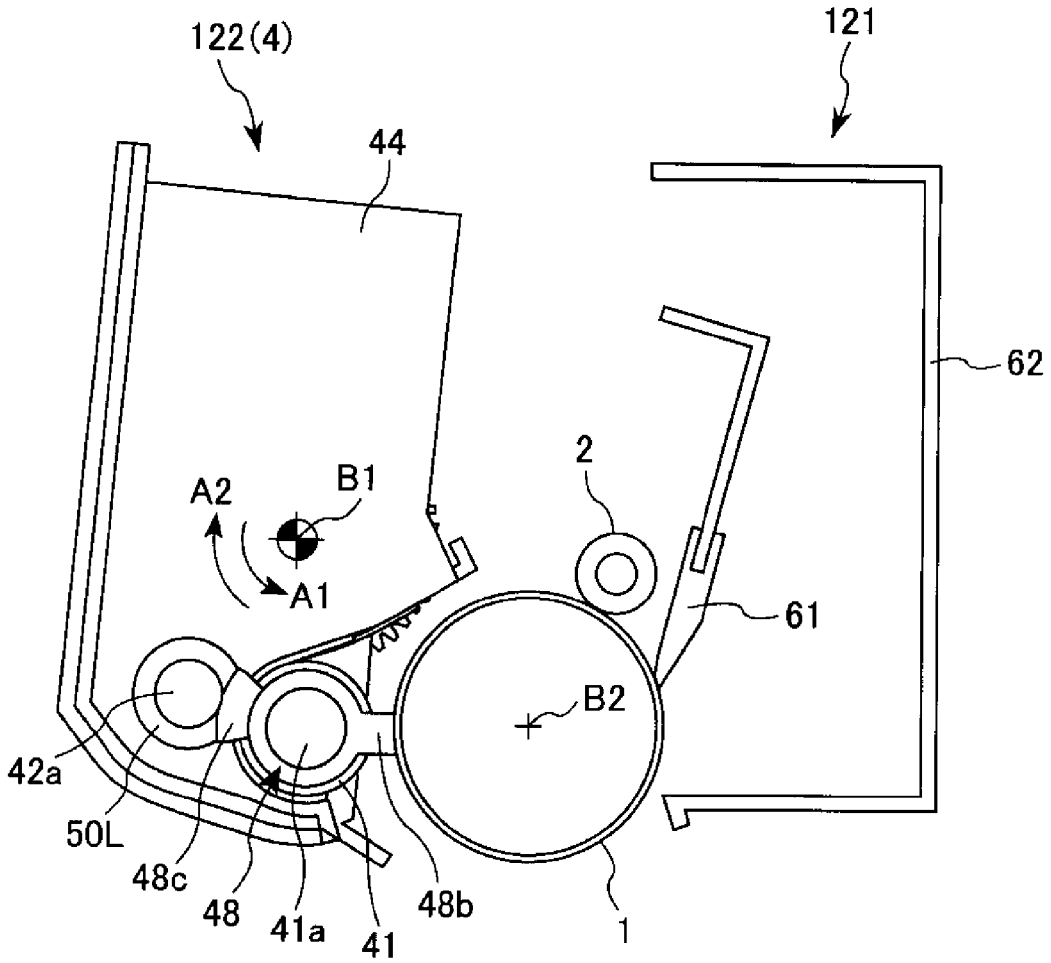
FIG. 7 is a schematic sectional view of the process cartridge in Embodiment 1.

FIG. 7 shows a state in which the developing device 4 is rotated in an arrow A2 direction in FIG. 7 with the swing center B1 as a (rotational) fulcrum by the spacer member 48 described later specifically (i.e., a state in which the developing device 4 is in a spaced state).

6. Structure of Spacer Member

A structure of the spacer member 48 will be specifically described.

Figure 8:
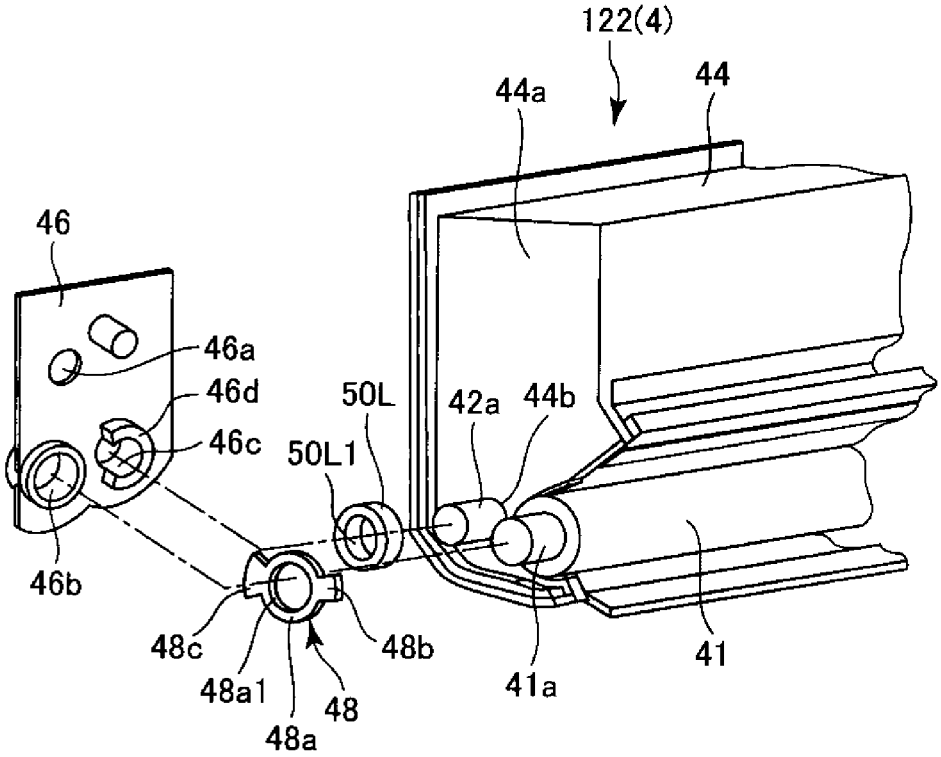
FIG. 8 is an assembling perspective view of a non-driving side end portion of the developing device and its neighborhood in Embodiment 1.

FIG. 8 is an assembling perspective view showing the non-driving side end portion of the developing device 4 with respect to the longitudinal direction. The core material 42*a* of the supplying roller 42 is exposed from the through hole 44*b* open at the non-driving side end surface 44*a* of the developing device frame 44. To the exposed core material 42*a*, the non-driving side seal 50L is mounted. The non-driving side seal 50L is an annular member having a predetermined thickness with respect to the longitudinal direction of the developing device 4. In this embodiment, the non-driving side seal 50L is formed with a sponge.

The non-driving side seal 50L is mounted to the core material 42*a* of the supplying roller 42 by engaging its inner diameter portion 50L1 with the core material 42*a* of the supplying roller 42. Then, when the non-driving side bearing member 46 is mounted to the developing device frame 44, the core material 42*a* of the supplying roller 42 is engaged with a supplying roller supporting hole 46*c* of the non-driving side bearing member 46, so that the supplying roller 42 is rotatably supported by the non-driving side bearing member 46. At this time, a projection 46*d* provided at a periphery of the supplying roller supporting hole 46*c* of the non-driving side beating member 46 presses the non-driving side seal 50L toward the developing device frame 44 side. Thus, the non-driving side seal 50L is compressed in the longitudinal direction of the developing device 4, so that the toner leakage from the inside of the developing device frame 4 is prevented.

In this embodiment, also as a constitution of the driving side supplying roller shaft seal 50R, the same constitution as that of the non-driving side supplying roller shaft seal 50L is used.

To the core material (shaft portion) 41*a*, of the developing roller 41, projected outward from the non-driving side end surface 44*a* of the developing device frame 44, the spacer member 48 is mounted. The spacer member 48 includes an annular portion 48*a* as a supporting and receiving portion. The annular portion 48*a* has an annular shape and is engaged with the core metal 41*a*. Further, the spacer member 48 includes a contact portion 48*b* projected outward from the annular portion 48*a* in its radial direction. Further, the spacer member 48 includes a portion-to-be-phase-determined-portion (first portion-to-be-phase-determined-portion) 48*c* projected outward from the annular portion 48*a* in its radial direction. The portion-to-be-phase-determined-portion 48*c* is a portion for determining the position of the spacer member 48 with respect to the rotational direction, i.e., a portion where a phase-determining portion described later acts (engages with) the portion-to-be-phase-determined-portion 48*c* when a phase of the spacer member 48 is determined. In this embodiment, the annular portion 48*a*, the contact portion 48*b* and the portion-to-be-phase-determined-portion 48*c* have the same predetermined thickness with respect to the longitudinal direction of the developing device 4 and have side surfaces flush with each other in each of sides of the spacer member 48 with respect to the longitudinal direction of the developing device 4. Further, with respect to a rotational axis (rotation center) of the annular portion 48*a*, the contact portion 48*b* and the portion-to-be-phase-determined-portion 48*c* are provided substantially symmetrically. In this embodiment, the rotational axis of the annular portion 48*a* and a rotational axis (rotation center) of the developing roller 41 is the same.

The spacer member 48 is rotatably supported by the core material 41*a* of the developing roller 41 by engagement of the core material 41*a* of the developing roller 41 with an inner diameter portion 48*a*1 of the annular portion 48*a*. Then, when the non-driving side bearing member 46 is mounted to the developing device frame 44, the core material 41*a* of the developing roller 41 is engaged with a developing roller supporting hole 46*b* of the non-driving side bearing member 46, so that the developing roller 41 is rotatably supported by the non-driving side bearing member 46. At this time, the non-driving side bearing member 46 is mounted outside the developing device 4 with respect to the longitudinal direction and therefore the spacer member 48 is not disengaged (detached) from the core material 41*a* of the developing roller 41.

In this embodiment, the non-driving side seal 50L has the function as a phase-determining portion (first phase-determining portion) for determining the position of the spacer member 48 with respect to the rotational direction, i.e., for determining a phase of the spacer member 48. As described later specifically, when the non-driving side bearing member 46 is mounted to the developing device frame 44, a part of the non-driving side seal 50L is pressed toward the developing device frame 44 side by the side surface, in the developing device frame 44 side, of the portion-to-be-phase-determined-portion 48*c* of the spacer member 48. In other words, the portion-to-be-phase-determined-portion 48*c* of the spacer member 48 is pressed toward the non-driving side bearing member 46 side by an elastically repelling force of the compressed non-driving side seal 50L, so that phase determination of the spacer member 48 is effected. The projection 46*d* is not provided at a portion, at a periphery of the supplying roller supporting hole 46*c* of the non-driving side bearing member 46, corresponding to a position where the portion-to-be-phase-determined-portion 48*c* of the spacer member 48 is to be disposed.

In this embodiment, by the non-driving side seal 50L and the portion-to-be-phase-determined-portion 48*c*, a phase determining means for determining the phase of the spacer member 48 at a phase where the developing roller 41 and the photosensitive drum 1 are spaced is constituted.

Figure 9:
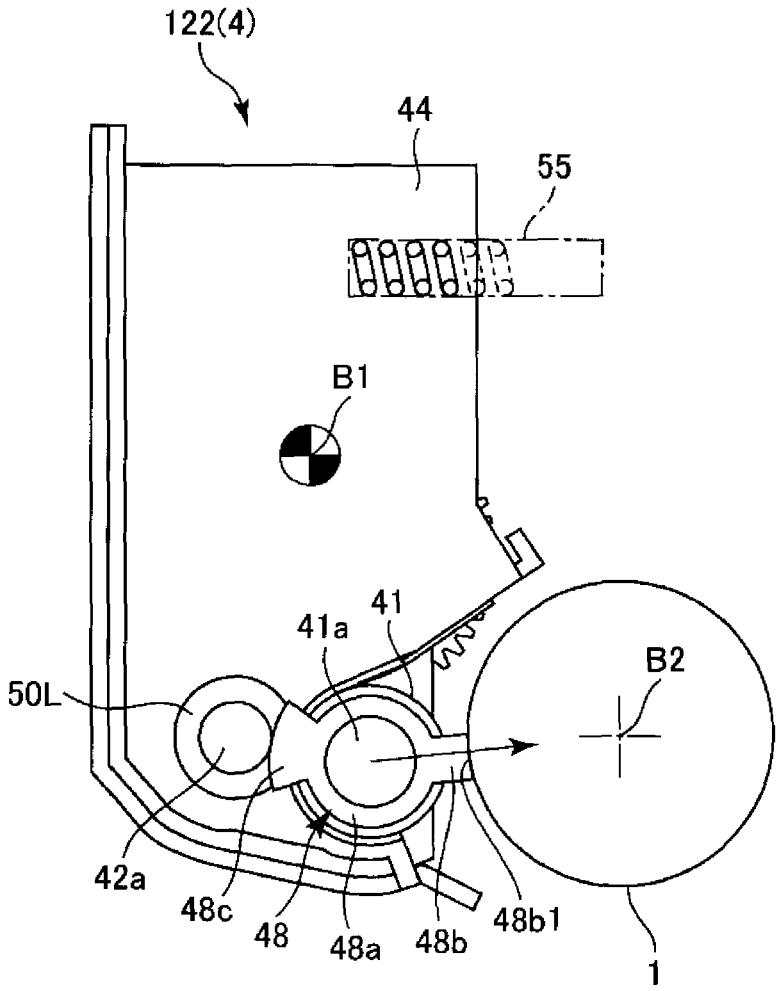
FIG. 9 is a schematic sectional view of the non-driving side end portion of the developing device and its neighborhood in Embodiment 1.

Next, with reference to FIG. 9, a positional relation between the spacer member 48 and the non-driving side seal 50L will be described. FIG. 9 is a side view of the developing device 4. In FIG. 9, the non-driving side cover member 125, the non-driving side bearing member 46 and the non-driving side end portion member 1*b* of the photosensitive drum 1 are omitted from illustration.

The spacer member 48 is supported by the core material 41*a* rotatably about the core material 41*a*, of the developing roller 41, as a (rotational) fulcrum.

However, when the spacer member 48 is located at a predetermined phase, the portion-to-be-phase-determined-portion 48*c* of the spacer member 48 is provided so as to overlap with the non-driving side seal 50L with respect to the longitudinal direction of the spacer member 48. For that reason, the spacer member 48 is, when it is located at the predetermined phase, phase-determined by an elastic force applied from the non-driving side seal 50L to the portion-to-be-phase-determined-portion 48*c* and thus cannot be rotated freely.

Here, the predetermined phase of the spacer member 48 after the spacer member 48 is mounted to the developing device 4 and before the use of the developing device 4 is started is a phase where a center axis of the contact portion 48*b* contacting the photosensitive drum 1 is directed in a direction of a rotational axis (rotation center) B2 of the photosensitive drum 1. When the spacer member 48 is assembled at the phase into the process cartridge 120, a contact surface 48*b*1 of the contact portion 48*b* of the spacer member 48 is contacted to the photosensitive drum 1, so that a spaced state between the developing roller 41 and the photosensitive drum 1 can be maintained.

In this embodiment, the contact portion 48*b* is formed in a rectangular prism-like shape extended from the annular portion 48*a* toward the photosensitive drum 1 in a rectilinear line. Further, in this embodiment, the portion-to-be-phase-determined-portion 48*c* is formed in a sector-like shape which is extended from the annular portion 48*a* toward the non-driving side seal 50L and which widens toward the outside with respect to the radial direction of the annular portion 48*a*.

7. Spaced State-Eliminating Operation by Spacer Member

Parts (a) and (c) of FIG. 10 are side views for illustrating an operation by which the state between the developing roller 41 and the photosensitive drum 1 is changed from a spaced state by the spacer member 48 to a state in which the spaced state by the spacer member 48 is eliminated to bring the developing roller 41 and the photosensitive drum 1 into contact with each other. In FIG. 10, the non-driving side cover member 125, the non-driving side bearing member 46 and the non-driving side end portion member 1*b* of the photosensitive drum 1 are omitted from illustration.

Part (a) of FIG. 10 shows a state during distribution or storage from after manufacturing of the process cartridge 120 until a user starts use of the process cartridge 120.

In this state, the spacer member 48 is located at a phase where the contact surface 48*a*1 of the contact portion 48*a* contacts the photosensitive drum 1. As a result, the developing roller 41 is spaced from the photosensitive drum 1 by a distance G1. At this time, the spacer member 48 is phase-determined by an elastic force applied from the non-driving side seal 50L to the portion-to-be-phase-determined-portion 48*c*.

As described above, the developing device 4 is always urged so that the developing roller 41 is rotationally moved, about the swing center R1 as the rotation center, by the urging spring (not shown) in the direction in which the developing roller 41 is contacted to the photosensitive drum 1. There is a need to set strength, of the spacer member 48, such that the spacer member 48 can withstand the urging force by the urging spring and an impact force during distribution and during storage.

In the case where the contact portion 48*b* of the spacer member 48 has a shape such that it receives bending moment when it resists the urging force and the impact force, large stress is exerted on a base portion which receives the bending moment.

On the other hand, in this embodiment, the contact portion 48*a* is located at a position where it is sandwiched between the core material 41*a* of the developing roller 41 and the photosensitive drum 1. As a result, a force applied to the spacer member 48 is only a force of compression in an arrow F direction in (a) of FIG. 10 toward the contact portion 48*a* extending between a rotational axis B3 of the developing roller 41 and the rotational axis B2 of the photosensitive drum 1. Therefore, the spacer member 48 may only be required to be capable of resisting the compression force and thus may only be required to be formed of a material in shape such that the material and the shape are not collapsed, so that even a relatively small part can space the developing roller 41 from the photosensitive drum 1.

Part (b) of FIG. 10 shows a state when the user starts use of the process cartridge 120.

When the user starts use of the process cartridge 120, the photosensitive drum 1 is rotated in the arrow R1 direction in (b) of FIG. 10 by receiving the driving force from a driving source (not shown) of the apparatus main assembly 110. The spacer member 48 receives the frictional force between the contact portion 48*b* and the photosensitive drum 1 and, as indicated by an arrow A3 in the figure, is rotated in a normal direction which is the same direction as the rotational direction of the photosensitive drum 1 at the contact position between itself and the photosensitive drum 1. This rotational direction is the normal rotational direction of the spacer member 48.

As described above, the spacer member 48 is phase-determined by the elastic force received from the non-driving side seal 50L at the portion-to-be-phase-determined-portion 48*c*. A phase-determining force F2 is a frictional force generated by the elastic force of the non-driving side seal 50L. On the other hand, a rotational force F3, received from the photosensitive drum 1, for rotating the spacer member 48 is set at a value larger than that of the phase-determining force F2. That is, the shape and material of the spacer member 48 are determined so as to satisfy the following force relationship.

(Force $F2$ for phase-determining spacer member 48)<
(Force $F$ for rotating spacer member 48)

Therefore, the spacer member 48 is continuously rotated further by the rotational force F3 received from a contact portion D with the photosensitive drum 1.

At this time, the developing device 4 is swingably supported as described above and therefore is rotated in an arrow A1 direction with the swing center B1 as the (rotation) fulcrum. Correspondingly, a distance G2 between the developing roller 41 and the photosensitive drum 1 is gradually decreased. That is, by the rotation of the spacer member 48, the developing device 4 is permitted to move to a position (close position) where the developing roller 41 is close to the photosensitive drum 1.

Incidentally, the projection 46*d* provided at the periphery of the supplying roller supporting hole 46*c* of the non-driving side bearing member 46 is cut away in a shape such that the movement of the portion-to-be-phase-determined-portion 48*c* of the spacer member 48 is permitted.

Part (c) of FIG. 10 shows a state in which the rotation of the spacer member 48 is ended and then the developing roller 41 and the photosensitive drum 1 contact at the contact portion D.

When the contact portion 48*b* of the spacer member 48 is rotated until the position where it is in non-contact with the photosensitive drum 1, the spacer member 48 receives the frictional force by the rotation of the core material 41*a* of the developing roller 41, thus being further rotated in the normal rotational direction (the arrow A3 direction in the figure). In this embodiment, the spacer member 48 is rotated to the position where the distance between the photosensitive drum 1 and the spacer member 48 is a distance G3 at the closest portion.

In this embodiment, in order to permit smooth rotation after the contact state of the spacer member 48 with the photosensitive drum 1, the portion-to-be-phase-determined-portion 48*c* of the spacer member 48 is provided by cutting away the projection 46*d*. That is, when the contact portion 48*b* of the spacer member 48 is spaced from the photosensitive drum 1 by the distance G3, the shape of the portion-to-be-phase-determined-portion 48*c* is determined so that the closest portion between the portion-to-be-phase-determined-portion 48*c* and the non-driving side seal 50L provides a gap G5. Further, this gap G5 is set at a small value to the extent that the contact portion 48*b* of the spacer member 48 does not contact the photosensitive drum 1 even when the spacer member 48 is rotated in a reverse rotational direction indicated by an arrow A4 in (c) of FIG. 10. That is, in this state, a compression force toward the non-driving side seal 50L by the portion-to-be-phase-determined-portion 48*c* is eliminated, and the non-driving side seal 50L is substantially restored to a natural state by its elastic restoring force, so that the gap G5 constitutes an obstruction when the portion-to-be-phase-determined-portion 48*c* is rotated in the reverse rotational direction (arrow A4 direction in the figure).

Further, the developing device frame 44 is provided with a normal rotation-preventing portion 44*c* so as to prevent excessive rotation of the spacer member 48 in the normal rotational direction (arrow A3 direction in the figure). As a result, the rotation of the spacer member 48 in the normal rotational direction is prevented when the spacer member 48 contacts the normal rotation-preventing portion 44*c*. 8. Phase determination with respect to vibration during distribution or storage FIG. 11 is a side view for illustrating a state of the spacer member 48 when the process cartridge 120 receives the large impact during distribution or storage. In FIG. 11, the non-driving side cover member 125, the non-driving side bearing member 46 and the non-driving side end portion member 1*b* of the photosensitive drum 1 were omitted.

The developing device 4 is swingably supported as described above. For that reason, when the process cartridge 120 receives the impact, in some cases, the developing device 4 is also rotated in the direction in which the developing device 4 is spaced from the photosensitive drum 1 against the force of the urging spring for urging the developing device 4 toward the photosensitive drum 1, i.e., in the arrow A2 direction in FIG. 11. At this time, the contact portion 48*b* of the spacer member 48 is spaced from the photosensitive drum 1.

However, according to this embodiment, even when the spacer member 48 is placed in such a state, the portion-to-be-phase-determined-portion 48*c* receives the frictional force from the non-driving side seal 50L, so that the phase of the spacer member 48 is maintained. For that reason, when the impact is settled, the contact portion 48*b* of the spacer member 48 contacts the photosensitive drum 1. That is, the spaced state between the developing roller 41 and the photosensitive drum 1 by the spacer member 48 is maintained.

Thus, according to this embodiment, the developing device 4 as the process unit includes the developing roller 41 as the process member acting on the rotatable photosensitive member 1 and the non-driving side bearing member 46 as the supporting frame for supporting the developing roller 41. The developing roller 41 of the developing device 4 is capable of taking a first position (FIG. 2) during use and a second position (FIG. 7) where the developing roller 1 is spaced from the photosensitive member 1 more than that during use. That is, the developing device 4 is movable between the position (close position: FIG. 2) where the developing roller 41 is close to the photosensitive member 1 with respect to the cleaning unit and the position (spaced position: FIG. 7) where the photosensitive drum 1 is spaced from the photosensitive member 1.

Further, the developing device 4 includes the spacer member 48 as the regulating (preventing) member capable of keeping the developing roller 41 at the second position and the core material 41*a*, of the developing roller 41, as the supporting portion for rotatably supporting the spacer member 48. Further, the developing device 4 includes the non-driving side seal 50L as the phase-determining portion capable of positioning the spacer member 48 at a position where the spacer member 48 is capable of keeping the developing roller 41 at the second position.

The spacer member 48 includes the annular portion 48*a* as a support-receiving portion for being rotatably supported by the supporting portion 41*a*. Further, the spacer member 48 includes the contact portion 48*b* contacted to the photosensitive member 1 or the end portion member 1*b*, provided at the end portion of the photosensitive member 1 with respect to the rotational axis direction, when the developing roller 41 is kept at the second position. Further, the spacer member 48 includes the portion-to-be-phase-determined-portion 48*c* (engaged with the phase-determining portion 50L) subjected to the action of the phase-determining portion 50L. Then, by the rotation of the photosensitive member 1, the contact state of the contact portion 48*b* with the photosensitive member 1 or the end portion member 1*b* is eliminated against the force for determining the rotational direction position of the spacer member 48 by the phase-determining portion 50L, so that the developing roller 41 is located at the first position. Further, in this embodiment, the contact portion 48*a* is located between the rotational axis of the photosensitive member 1 and the rotational axis of the spacer member 48. Further, in this embodiment, the developing device 4 includes the normal rotation-preventing portion 44*c* for preventing the rotation of the spacer member 48 in the direction in which the contact state is eliminated after the contact state is eliminated.

As described above, the spacer member 48 for spacing the developing roller 41 is sandwiched and disposed between the core material 41*a* of the developing roller 41 and the photosensitive drum 1. Therefore, the shape and material of the spacer member 48 may only be required to resist the compression, so that downsizing of parts is easy. Further, the spacer member 48 is downsized to be light in weight, so that the vibration received by the spacer member 48 during distribution or storage, i.e., a force generated from acceleration is small. For that reason, even when the force for phase-determining the spacer member 48 (the elastic force of the non-driving side seal 50L in this embodiment) is not increased, it is possible to easily perform the phase determination of the spacer member 48 during distribution or storage.

For example, in an experiment in which the spacer member 48 was prepared by using the resin material (polyacetal) and was mounted to the developing device 4, even when the impact was exerted on the developing device 4 by applying 250G (gravitational acceleration) to the developing device 4, the spacer member 48 was able to be kept in the phase-determined state.

Further, by rotating the spacer member 48 by the frictional force generated by the contact with the photosensitive drum 1, the spaced state between the developing roller 41 and the photosensitive drum 1 can be eliminated. That is, with the start of the use of the process cartridge 120 by the user, the spaced state between the developing roller 41 and the photosensitive drum 1 by the spacer member 48 can be eliminated automatically. For that reason, an operation for eliminating the spaced state formed by the spacer member 48 can be eliminated, so that good image formation can be effected by the image forming apparatus.

(Embodiment 2)

Next, another embodiment of the present invention will be described basic constitutions and operations of the developing device, the process cartridge and the image forming apparatus in this embodiment are the same as those in Embodiment 1. Therefore, elements having the same or corresponding functions and constitutions as those for the image forming apparatus in Embodiment 1 are represented by the same reference numerals or symbols and will be omitted from detailed description.

In this embodiment, the spacer member 48 bearing member 46 includes a phase-determining portion acting on the portion-to-be-phase-determined-portion.

FIG. 12 is an assembling perspective view showing the developing device 4 in the non-driving side. Parts (a) and (b) of FIG. 13 and (a) and (b) of FIG. 14 are sectional views of the developing roller 41 and the supplying roller 42 in the neighborhood of the non-driving side end portion as seen in a direction, indicated by an arrow V in FIG. 12, from an inside of the developing device frame 44 toward the non-driving side bearing member 46.

As shown in FIG. 12, the spacer member 48 is mounted to the core material 41*a* of the developing roller 41, and thereafter the non-driving side bearing member 46 is mounted to the developing device frame 44.

In this embodiment, the spacer member 48 includes the annular portion 48*a* and the contact portion 48*b* which are the same as those in Embodiment 1. Further, in this embodiment, the spacer member 48 includes the elastically deformable portion-to-be-phase-determined-portion 48*c*. The portion-to-be-phase-determined-portion 48*c* includes a base portion 48*c*1, an arm portion 48*c*2 as an elastically deformable portion, and a projection-shaped portion 48*c*3 as a locking portion.

In this embodiment, with respect to a rotational axis of the annular portion 48*a*, the contact portion 48*b* and the projection-shaped portion 48*c*3 of the portion-to-be-phase-determined-portion 48*c* are provided substantially symmetrically. In this embodiment, the rotational axis of the annular portion 48*a* and a rotational axis of the developing roller 41 is the same. The base portion 48*c*1 of the portion-to-be-phase-determined-portion 48*c* is located downstream of the projection-shaped portion 48*c*3 with respect to the normal rotational direction (arrow A3 direction in (a) of FIG. 12) of the spacer member 48 and is projected from the annular portion 48*a* toward the outside with respect to the radial direction of the annular portion 48*a*. The arm portion 48*c*2 is formed to be extended from the base portion 48*c*1 along an outer circumference of the annular portion 48*a*. The arm portion 48*c*2 is extended from the annular portion 48*a* toward the upstream side of the spacer member 48 with respect to the normal rotational direction (arrow A3 direction) of the spacer member 48. Further, in the neighborhood of a free end of the arm portion 48*c*2, the projection-shaped portion 48*c*3 is provided so as to be projected toward the outside with respect to the radial direction of the annular portion 48*a*. The arm portion 48*c*2 is capable of bending the projection-shaped portion 48*c*3 so as to be moved toward the inside of the annular portion 48*a* with respect to the radial direction of the annular portion 48*a*.

In this embodiment, different from Embodiment 1, the non-driving side seal 50L has no function as the phase-determining portion and is configured to have a size such that it does not contact the portion-to-be-phase-determined-portion 48*c*3 of the spacer member 48.

The non-driving side bearing member 46 is provided with a phase-determining portion 46*d* at a position where it opposes the projection-shaped portion 48*c*3 of the portion-to-be-phase-determined-portion 48*c*3 of the spacer member 48 located at a phase where the contact portion 48*b* contacts the photosensitive drum 1.

In this embodiment, the projection-shaped portion 48*c*3 of the spacer member 48 is held by the phase-determining portion 46*d* of the non-driving side baring member 46, so that the phase of the spacer member 48 is determined.

The projection-shaped portion 48*c*3 is engaged with the phase-determining portion 46*d* by bending the arm portion 48*c*2 in a direction toward the annular portion 48*a* as indicated by an arrow A5 in (a) and (b) of FIG. 13.

The phase-determining portion 46*d* has an inclined surface 46*d*1 which is inclined with respect to a tangential line direction of a top portion 48*c*4 of the projection-shaped portion 48*c*3 with respect to the rotational direction of the spacer member 48. The inclined surface 46*d*1 in inclined in a direction in which it approaches the rotational axis of the annular portion 48*a* with a position closer to the downstream side of the spacer member 48 with respect to the normal rotational direction (arrow A3 direction in (a) and (b) of FIG. 13). In this embodiment, the inclined surface 46*d*1 contacts a downstream-side side surface 48*c*5 which is a downstream-side surface of the projection-shaped portion 48*c*3 with respect to the normal rotational direction (arrow A3 direction in (a) and (b) of FIG. 13).

Further, the phase-determining portion 46*d* is provided with a reverse rotation preventing portion 46*d*2 contacting the portion-to-be-phase-determined-portion 48*c* when the spacer member 48 is rotated in a reverse rotational direction (arrow A4 direction in (a) and (b) of FIG. 13). In this embodiment, the reverse rotation-preventing portion 46*d*1 contacts an upstream side surface 48*c*6 as an upstream-side surface of the projection-shaped portion 48*c*3 with respect to the normal rotational direction (arrow A3 direction in (a) and (b) of FIG. 13 and contacts a free end-side end surface 48*c*7 of the arm portion 48*c*2.

Therefore, the phase-determining portion 46*d* prevents the rotation of the spacer member 48 in the normal rotational direction (arrow A3 direction in the figures) by the inclined surface 46*d*1 and prevents the rotation of the spacer member 48 in the reverse rotational direction (arrow A4 direction in the figures) by the reverse rotation-preventing portion 46*d*2.

In this embodiment, by the phase-determining portion 46*d* and the portion-to-be-phase-determined-portion 48*c*, a phase determining means for determining the phase of the spacer member 48 at a phase where the developing roller 41 and the photosensitive drum 1 are spaced is constituted.

With reference to (a) and (b) of FIG. 13 and (a) and (b) of FIG. 14, an operation by which the state between the developing roller 41 and the photosensitive drum 1 is changed from a spaced state by the spacer member 48 to a state in which the spaced state by the spacer member 48 is eliminated to bring the developing roller 41 and the photosensitive drum 1 into contact with each other will be described.

Part (a) of FIG. 13 shows a state during distribution or storage from after manufacturing of the process cartridge 120 until a user starts use of the process cartridge 120.

In this state, the spacer member 48 is located at a phase where the contact surface 48*a*1 of the contact portion 48*a* contacts the photosensitive drum 1. As a result, the developing roller 41 is spaced from the photosensitive drum 1. At this time, the projection-shaped portion 48*c*3 of the portion-to-be-phase-determined-portion 48*c* of the spacer member 48 is held by the phase-determining portion 46*d* of the bearing member 46. In this state, even when the process cartridge 120 is subjected to large impact during distribution or storage, similarly as in the case of Embodiment 1 described with reference to FIG. 11, the phase of the spacer member is determined and therefore the spaced state between the developing roller 41 and the photosensitive drum 1 is maintained.

Part (b) of FIG. 13 shows a state when the user starts use of the process cartridge 120.

When the user starts use of the process cartridge 120, the photosensitive drum 1 is rotated in the arrow R1 direction in (b) of FIG. 10 by receiving the driving force from a driving source (not shown) of the apparatus main assembly 110. The spacer member 48 receives the frictional force between the contact portion 48*b* and the photosensitive drum 1 and, as indicated by an arrow A3 in the figure, is rotated in a normal direction which is the same direction as the rotational direction of the photosensitive drum 1 at the contact position between itself and the photosensitive drum 1. This rotational direction is the normal rotational direction of the spacer member 48.

At this time, the portion-to-be-phase-determined-portion 48 of the spacer member 48 is to be detached from the inclined surface 46*d*1 of the phase-determining portion 46*d* by further bending the elastically deformable arm 47*d* more than the state of (a) of FIG. 13.

The inclined surface 46*d*1 is, when the spacer member 48 is rotated in the normal rotational direction (arrow A3 direction in (a) and (b) of FIG. 13), inclined in a direction in which the arm portion 48*c*2 of the spacer member 48 is deformed in an arrow A5 direction in the figures. Further, the phase-determining portion 46 is provided with the reverse rotation-preventing portion 46*d*2 for preventing the rotation of the spacer member 48 in the reverse rotational direction (arrow A4 direction in (a) of FIG. 13). In this embodiment, the reverse rotation-preventing portion 46*d*2 has a surface perpendicular to the rotational direction of the spacer member 48 (arrow A3 or A4 direction in (a) of FIG. 13). As a result, in the case where the photosensitive drum 1 is rotated in a direction opposite to a normal rotational direction (arrow R1 direction in (b) of FIG. 13) by the vibration thereof during distribution or storage, the rotation of the spacer member 48 together with the photosensitive drum 1 in the reverse rotational direction (arrow A4 direction in (a) of FIG. 13) can be prevented. However, as desired, a constitution in which the reverse rotation-preventing member 46*d*2 is not provided may also be employed.

A height H1 of the inclined surface 46*d*1 of the phase-determining portion 46*d* and a height H2 of the reverse rotation-preventing portion 46*d*2 with respect to the arrow A5 direction, in (a) of FIG. 13, which is a bending direction of the arm portion 48*c*2 of the spacer member 48 can be appropriately be set. At the time of the setting, it is possible to take into consideration a magnitude of the vibration generated during distribution or storage, a bending force when the arm portion 48*c*2 of the spacer member 48 is bent in the arrow A5 direction in (a) of FIG. 13, a rotational force applied from the photosensitive drum 1, and the like. That is, a force by which the arm portion 48*c*2 gets over the inclined surface 46*d*1 is made smaller than the force, applied from the photosensitive drum 1 to the spacer member 48, for rotating the spacer member 48 and is made larger than a force by which the arm portion 48*c*2 gets over the inclined surface 46*d*1 by the rotation of the spacer member 48 during distribution or storage.

Part (a) of FIG. 14 shows a state in which engagement of the portion-to-be-phase-determined-portion 48*c* of the spacer member 48 with the phase-determining portion 46*d* is eliminated and thus the contact portion 48*b* of the spacer member 48 is to be spaced from the photosensitive drum 1.

In this state, the arm portion 48*c*2 of the spacer member is restored to a natural state in which the arm portion n48*c*2 is not bent. Then, the spacer member 48 is continuously rotated by receiving the rotational force from the contact portion D with the photosensitive drum 1.

Part (b) of FIG. 14 shows a state in which the rotation of the spacer member 48 is ended and then the developing roller 41 and the photosensitive drum 1 contact at the contact portion D.

When the contact portion 48*b* of the spacer member 48 is rotated until the position where it is in non-contact with the photosensitive drum 1, the spacer member 48 receives the frictional force by the rotation of the core material 41*a* of the developing roller 41, thus being further rotated in the normal rotational direction (the arrow A3 direction in the figure). In this embodiment, the spacer member 48 is rotated to the position where the distance between the photosensitive drum 1 and the spacer member 48 is a distance G3 at the closest portion.

Further, the developing device frame 44 is provided with a normal rotation-preventing portion 44*c* so as to prevent excessive rotation of the spacer member 48 in the normal rotational direction (arrow A3 direction in the figure). As a result, the rotation of the spacer member 48 in the normal rotational direction is prevented when the spacer member 48 contacts the normal rotation-preventing portion 44*c*.

In this embodiment, the example in which the non-driving side seal 50L does not contact the portion-to-be-phase-determined-portion 48*c* of the spacer member 48 is described but may also contact the portion-to-be-phase-determined-portion 48*c* of the spacer member 48 if the non-driving side seal 50L does not inhibit the operation of the spacer member 48.

In this embodiment, the portion-to-be-phase-determined-portion 48*c* includes the projection-shaped portion 48*c*3 projected toward the phase-determining portion 46*d*, and the phase-determining portion d has a recessed shape corresponding to the projection-shaped portion 48*c*3. By reversing this shape relationship, the portion-to-be-phase-determined-portion 48*c* may also have the recessed shape and the phase-determining portion 46*d* may also have the projected shape.

Thus, in this embodiment, one of the phase-determining portion and the portion-to-be-phase-determined-portion includes the arm portion 48*c*2 as the elastically deformable portion for being elastically deformed by the other portion.

The arm portion 48*c*2 is, when the spacer member 48 is rotated in the direction in which the contact state of the contact portion 48*b* with the photosensitive drum 1 or the end portion member 1*b* is eliminated, elastically deformed in a direction in which the action of the portion-to-be-phase-determined-portion on the phase-determining portion (engagement of the portion-to-be-phase-determined-portion with the phase-determining portion) is eliminated. Further, the above-described the other portion of the phase-determining portion and the portion-to-be-phase-determined-portion includes the reverse rotation-preventing portion 46*d*2 for preventing the rotation of the spacer member 48 in a direction opposite to the direction at the time when the contact state is eliminated.

As described above, according to this embodiment, an effect similar to that in Embodiment 1 can be obtained. Further, according to this embodiment, by the shapes of the portion-to-be-phase-determined-portion 48*c* and the phase-determining portion 46*d*, a force for phase-determining the spacer member 48 is readily made larger than that in Embodiment 1.

(Embodiment 3)

Next, another embodiment of the present invention will be described basic constitutions and operations of the developing device, the process cartridge and the image forming apparatus in this embodiment are the same as those in Embodiments 1 and 2. Therefore, elements having the same or corresponding functions and constitutions as those for the image forming apparatus in Embodiments 1 and 2 are represented by the same reference numerals or symbols and will be omitted from detailed description.

Particularly, in this embodiment, a constitution of the phase-determining means of the spacer member is substantially the same as that in Embodiment 1.

FIG. 15 is a sectional view showing the spacer member 48 and its neighborhood in this embodiment. FIG. 16 is an assembling perspective view of the spacer member 48 and its neighborhood in this embodiment.

In this embodiment, a modified example of the constitution for rotating the spacer member 48 in the case where it is assumed that the impact during distribution or storage is large and therefore there is a need to increase the force for phase-determining the portion-to-be-phase-determined-portion 48*c* of the spacer member 48 will be described.

The force for phase-determining the spacer member 48 can be increased by, e.g., enhancing stiffness (rigidity) of the elastically deformable arm portion 48*c*2 as a part of the portion-to-be-phase-determined-portion 48*c* of the spacer member 48. That is, the force for phase-determining the spacer member 48 can be increased by making the arm portion 48*c*2 less deformable. Alternatively, the force for phase-determining the spacer member 48 can be increased by increasing the height H1 of the inclined surface 46*d*1 of the phase-determining portion 46*d* with respect to the arrow A5 direction shown in (a) of FIG. 13 to increase an amount required for bending the arm portion 48*c*2 of the spacer member 48.

However, when the force for phase-determining the spacer member 48 is increased in this way, there is a possibility that the spacer member 48 cannot be rotated by only a force generated based on the frictional force between the contact portion 48*b* and the photosensitive drum 1.

Therefore, in this embodiment, the non-driving side end portion member 1*b* of the photosensitive drum 1 is provided with a spacing-eliminating portion 1*c* as an engaging portion to be engaged with the contact portion 48*b* of the spacer member 48 to forcedly rotate the spacer member 48. That is, in this embodiment, the non-driving side end portion member 1*b* provided integrally with the photosensitive drum 1 is provided with the spacing-eliminating portion 1*c* (recessed portion) which is provided by cutting away the non-driving side end portion member 1*b* in a recessed shape toward the inside thereof with respect to the radial direction of the photosensitive drum 1.

That is, in this embodiment, the contact portion 48*b* of the spacer member 48 mounted to the core material 41*a* of the developing roller 41 contacts the spacing-eliminating portion 1*c* to space the developing roller 41 from the photosensitive drum 1.

Then, when the photosensitive drum 1 is rotated, correspondingly thereto, also the non-driving side end portion member 1*b* is integrally rotated in the same direction. As a result, an eliminating surface (urging portion) 1*c*1, extending in the radial direction of the photosensitive drum 1, located in the upstream side of the spacing-eliminating portion 1*c* with respect to the rotational direction of the photosensitive drum 1 pushes the spacer member 48. Specifically, the eliminating surface 1*c*1 pushes a side surface 48*b*2 of the contact portion 48*b*, in the neighborhood of a contact surface 48*b*1 of the spacer member 48, located in the upstream side with respect to the normal rotational direction of the spacer member 48 (arrow A3 direction in FIG. 15). Thus, the spacing-eliminating portion 1*c* is engaged with the contact portion 48*b* to rotate the spacer member 48. This force for rotating the spacer member 48 by the spacing-eliminating portion 1*c* can be easily made larger than the frictional force between the photosensitive drum 1 and the spacer member 48.

Thus, in this embodiment, the contact portion 48*b* contacts the end portion member 1*b*. Further, the end portion member 1*b* is provided with the spacing-eliminating portion 1*c* as the engaging portion engaged, when the contact state of the contact portion 48*b* with the end portion member 1*b* is eliminated, with the contact portion 48*b* to rotate the spacer member 48.

In this embodiment, as shown in FIG. 16, the non-driving side end portion member 1*b* of the photosensitive drum 1 is located at a position where it substantially opposes the spacer member 48. However, as shown in (a) of FIG. 17, the non-driving side end portion member 1*b* of the photosensitive drum 1 may also be disposed at a position closer to the non-driving side end than the position shown in FIG. 16 with respect to the longitudinal direction of the process cartridge 120. In this case, as shown in (a) of FIG. 17, the contact portion 48*b* of the spacer member 48 is formed in a shape extended toward the non-driving side end with respect to the longitudinal direction of the process cartridge 120, so that the contact portion 48*b* can be contacted to the non-driving side end portion member 1*b*.

Part (b) of FIG. 17 is a perspective view of the spacer member 48 in this case. In the spacer member 48 shown in the figure, the contact portion 48*b* is formed by extending its contact surface 48*b*1, contactable with the spacing-eliminating portion 1*c* of the non-driving side end portion member 1*b* of the photosensitive drum 1, to a position where the contact surface 48*b*1 has a width L1 in the figure.

As described above, according to this embodiment, effects similar to those in Embodiments 1 and 2 can be obtained. Further, according to this embodiment, the spacer member 48 is rotated by the spacing-eliminating portion 1*c* provided to the end portion member 1*b* of the photosensitive drum 1, so that the spaced state between the developing roller 41 and the photosensitive drum 1 can be eliminated with high reliability.

Incidentally, the recording material rotating method as in this embodiment is not limited to Embodiment 2 but is similarly applicable to also other embodiments described herein.

Embodiment (4)

Next, another embodiment of the present invention will be described basic constitutions and operations of the developing device, the process cartridge and the image forming apparatus in this embodiment are the same as those in Embodiment 1. Therefore, elements having the same or corresponding functions and constitutions as those for the image forming apparatus in Embodiment 1 are represented by the same reference numerals or symbols and will be omitted from detailed description.

After the user starts the use of the process cartridge, when the preventing member for placing the photosensitive member and the process member in a state in which they are spaced more than during the use contacts the photosensitive member or other parts, there is a possibility that the image defect is generated. When the material for the preventing member is limited in order to prevent the photosensitive member or other parts from being damaged even when the preventing member contacts the photosensitive member or other parts, there is a possibility that a cost is increased. For that reason, after the spaced state by the preventing member is eliminated, it is also important that the preventing member is prevented from contacting the photosensitive member or other parts of the photosensitive member.

Therefore, an object of this embodiment is, after the use of the process cartridge is started, to prevent contact of the preventing member, with peripheral parts, which places the photosensitive member and the process member in the state in which they are spaced more than during the use.

Therefore, in this embodiment, in addition to the constitution of the phase-determining means, of the spacer member, as the preventing member similar to that in Embodiment 2, a constitution for performing further phase determination after the spaced state between the developing roller 41 and the photosensitive drum 1 is eliminated is employed.

Parts (a) and (b) of FIG. 18 and (a) and (b) of FIG. 19 are sectional views of the developing roller 41 and the supplying roller 42 in the neighborhood of the non-driving side end portion as seen in a direction, indicated by the arrow V in FIG. 12, from an inside of the developing device frame 44 toward the non-driving side bearing member 46.

With reference to (a) and (b) of FIG. 18 and (a) and (b) of FIG. 14, an operation by which the state between the developing roller 41 and the photosensitive drum 1 is changed from a spaced state by the spacer member 48 to a state in which the spaced state by the spacer member 48 is eliminated to bring the developing roller 41 and the photosensitive drum 1 into contact with each other will be described.

Part (a) of FIG. 18 shows a state during distribution or storage from after manufacturing of the process cartridge 120 until a user starts use of the process cartridge 120.

In this state, the spacer member 48 is located at a phase where the contact surface 48*a*1 of the contact portion 48*a* contacts the photosensitive drum 1. As a result, the developing roller 41 is spaced from the photosensitive drum 1.

Also in this embodiment, the non-driving side bearing member 46 is provided with the phase-determining portion 46*b* having substantially the same constitution as that of the phase-determining portion in Embodiment 2. In this embodiment, a guide portion 46*e* is further provided to the non-driving side bearing member 46. The guide portion 46*e* is provided downstream of the phase-determining portion 46*d* with respect to the normal rotational direction of the spacer member 48 (arrow A3 direction in (a) of FIG. 18). The guide portion 46*e* includes, as described later specifically, a guide surface 46*e*1 and a phase-determining surface 46*e*2 which are contactable to the portion-to-be-phase-determined-portion 48*c* of the spacer member 48.

Part (b) of FIG. 18 shows a state in which the user starts the use of the process cartridge 120.

Similarly as in Embodiment 2, when the photosensitive drum 1 is rotated in the normal rotational direction (arrow R1 direction in the figure), the projection-shaped portion 48*c*3 of the spacer member 48 is detached from the phase-determining portion 46*b* while the arm portion 48*c*2 of the spacer member 48 is elastically deformed.

Part (a) of FIG. 19 shows a state in which the spacer member 48 is further rotated in the normal rotational direction (arrow A3 direction in the figure) and thus the projection-shaped portion 48*c*3 of the portion-to-be-phase-determined-portion 48*c* is located in the neighborhood of an end portion position E1 of the guide surface 46*e*1 with respect to the same (arrow A3) direction.

The arm portion 48*c*2 of the spacer member 48 is, when the projection-shaped portion 48*c*3 contacts the guide surface 46*e*1 of the guide portion 46*e*, kept in a state in which it is bent toward the inside of the annular portion 48*a* with respect to the radial direction of the annular portion 48*a*.

Part (b) of FIG. 19 shows a state in which the rotation of the spacer member 48 is ended and then the developing roller 41 and the photosensitive drum 1 contact at the contact portion D.

As specifically shown in FIG. 20, the phase-determining surface 46*e*2 is provided continuously and downstream from the guide surface 46*e*1 with respect to the normal rotational direction of the spacer member 48 (arrow A3 direction in FIG. 19). When the spacer member 48 is rotated, the arm portion 48*c* contacts the guide surface 46*e*1 and movement thereof is guided by the guide surface 46*e*1, thus being guided from the contact position with the phase-determining portion 46*d* to a contact position with the phase-determining surface 46*e*2. The phase-determining surface 46*e*2 is constituted by a surface inclined from a tangential line, of the top portion 48*c*4 of the projection-shaped portion 48*c* at the end portion position E1 with respect to the rotational direction of the spacer member 48, toward the outside of the spacer member 48 with respect to the radial direction of the annular portion 48*a* by an angle θ.

As a result, when the spacer member 48 is further rotated in the normal rotational direction (arrow A3 direction) and the position of the top portion 48*c*4 of the projection-shaped portion 48*c*3 passes through the end portion position E1, the spacer member 48 receives a rotational force based on a component force Fs of normal reaction Fn of a force F for returning the arm portion 48*c*2 from the elastically deformed state to the original (normal) state.

By the rotation force, the spacer member 48 is rotated, as shown in (b) of FIG. 19, even when it does not receive the force from the photosensitive drum 1. In this embodiment, the spacer member 48 is rotated by the phase-determining surface (rotation-acting portion) 46*e*2 by a distance X shown in the figure. The distance X is a distance in which the top portion 48*c*4 of the projection-shaped portion 48*c*3 of the spacer member 48 moves from the end portion position E1 of the guide surface 46*e*1 to an end portion position E2 of the phase-determining position 46*e*2 with respect to the normal rotational direction of the spacer member 48 (arrow A3 direction in the figure). As a result, the spacer member 48 is rotated to a position where the closest portion between the photosensitive drum 1 and the contact portion 48*b* provides a distance G4.

In this embodiment, the spacer member 48 is phase-determined in a state shown in (b) of FIG. 19 irrespective of the frictional force from the core material 41*a* of the developing roller 41. By the phase determination by the phase-determining surface 46*e*2 of the guide portion 46*e*, the spacer member 48 is not rotated in the reverse rotational direction (arrow A4 direction in the figure).

In this embodiment, by the phase-determining portion 46*d* and the portion-to-be-phase-determined-portion 48*c*, the phase-determining means for phase-determining the spacer member 48 at a first phase where the developing roller 41 and the photosensitive drum 1 are spaced is constituted. Further, in this embodiment, by the guide portion 46*e* and the portion-to-be-phase-determined-portion 48*c*, a phase-determining means after the spacing elimination is constituted. The phase-determining means of the spacing elimination phase-determines, after the spaced state between the developing roller 41 and the photosensitive drum 1 by the spacer member 48 is eliminated, the spacer member 48 at a second phase where the spacer member 48 is retracted from the photosensitive drum 1 to be in non-contact with the photosensitive drum 1. Specifically, the guide portion 46*e* acts (engages with) the portion-to-be-phase-determined-portion 48*c* at the phase-determining surface 46*e*2 as the phase-determining portion after the spacing elimination (second phase-determining portion), thus determining the phase of the spacer member 48 after the spacing elimination.

Further, the developing device frame 44 is provided with a normal rotation-preventing portion 44*c* so as to prevent excessive rotation of the spacer member 48 in the normal rotational direction (arrow A3 direction in FIG. 19). As a result, the rotation of the spacer member 48 in the normal rotational direction is prevented when the spacer member 48 contacts the normal rotation-preventing portion 44*c*.

According to this embodiment, even in the case where the developing roller 41 is located in an upper side of the photosensitive drum 1 with respect to the gravitational direction depending on, e.g., a design factor of the developing device 4, it is possible to prevent the contact between the photosensitive drum 1 and the contact portion 48*b* of the spacer member 48 after the spaced state is eliminated. For that reason, it is possible to prevent the generation of the image defect due to inadvertent contact of the spacer member 48 with the photosensitive drum 1.

Thus, in this embodiment, the developing device 4 further includes the phase-determining surface 46*e*2, of the guide portion 46*e*, as the phase-determining portion after the spacing elimination. The phase-determining surface 46*e*2 of the guide portion 46*e* acts (engages with) the spacer member 48 after the contact state of the contact portion 48*b* with the photosensitive member 1 or the end portion member 1*b* is eliminated, so that the position of the spacer member 48 with respect to the rotational direction is determined at the position where the contact portion 48*b* does not contact the photosensitive member 1. In this embodiment, the phase-determining portion 46*d* is located upstream of the guide portion 46*e* with respect to the rotational direction of the spacer member 48 when the contact state is eliminated. Particularly, in this embodiment, the guide portion 46*e* includes the rotation-acting portion (phase-determining surface 46*e*2) for rotating the spacer member 48 in the rotational direction during the elimination of the contact state by receiving the repelling force of the arm portion 48*e*2 as the elastically deformable portion.

As described above, according to this embodiment, effects similar to those in Embodiments 1 and 2 can be obtained. Further, according to this embodiment, the phase-determining means, after the spacing elimination, for determining the phase of the spacer member 48 after the phase determination by the phase-determining means is eliminated to eliminate the spaced state between the developing roller 41 and the photosensitive drum 1 by the spacer member is further provided. As a result, the spacer member 48 is not reversely rotated (in the arrow A4 direction in (b) of FIG. 18) after the spaced state between the developing roller 41 and the photosensitive drum 1 is eliminated. That is, after the spaced state between the developing roller 41 and the photosensitive drum 1 by the spacer member 48 is eliminated, it is possible to avoid the contact between the spacer member 48 and the photosensitive drum 1 with reliability.

That is, according to this embodiment, by determining the phase of the spacer member after the start of use, it is possible to prevent the contact of the spacer member with its peripheral parts during the use. As a result, it is possible to reduce the possibility of the image defect due to the contact of the spacer member with its peripheral parts during the use.

(Embodiment 5)

Next, another embodiment of the present invention will be described basic constitutions and operations of the developing device, the process cartridge and the image forming apparatus in this embodiment are the same as those in Embodiments 1 and 2. Therefore, elements having the same or corresponding functions and constitutions as those for the image forming apparatus in Embodiments 1 and 2 are represented by the same reference numerals or symbols and will be omitted from detailed description.

In the above-described embodiments, the constitution in which the spacer member 48 is mounted to the core material 41*a* of the developing roller 41 so as to be rotatably supported was employed. However, the spacer member 48 can also be constituted so as to be mounted to and supported by a place other than the core material 41*a* of the developing roller 41.

FIG. 21 is an assembling perspective view of, as an example, the case where the spacer member 48 is mounted to the place other than the core material 41*a* of the developing roller 41 in the constitution of the phase-determining means of the spacer member similar to that in Embodiment 4.

For example, as shown in FIG. 21, as the supporting means for the spacer member 48, it is possible to provide the non-driving side bearing member 46 with a supporting portion 46*f*. The supporting portion 46*f* is formed in a cylindrical shape, projected toward the developing device frame 44, coaxial with the developing roller supporting hole 46*b* which is provided in the non-driving side bearing member 46 so as to support the core material 41*a* of the developing roller 41. Further, the inner diameter portion 48*a*1, as the support-receiving portion, of the annular portion 48*a* of the spacer member 48 is engaged with the supporting portion 46*f*, so that the spacer member 48 is rotatably supported by the non-driving side bearing member 46.

Also by such a mounting method of the spacer member 48, it is possible to realize the spacing operation between the developing roller 41 and the photosensitive drum 1 and to realize the spacing-eliminating operation similarly as in the above-described embodiments.

Incidentally, the recording material supporting method as in this embodiment is not limited to Embodiment 4 but is similarly applicable to also other embodiments described herein.

(Embodiment 6)

Next, another embodiment of the present invention will be described basic constitutions and operations of the developing device, the process cartridge and the image forming apparatus in this embodiment are the same as those in Embodiments 1 and 2. Therefore, elements having the same or corresponding functions and constitutions as those for the image forming apparatus in Embodiments 1 and 2 are represented by the same reference numerals or symbols and will be omitted from detailed description.

In this embodiment, the non-driving side bearing member 46 includes an elastically deformable phase-determining portion, and the spacer member 48 includes a portion-to-be-phase-determined-portion with which the phase-determining portion is engaged.

FIG. 22 is an assembling perspective view showing the developing device 4 at the non-driving side end portion with respect to the longitudinal direction of the developing device 4. FIG. 23 is a sectional view of the developing roller 41 and the supplying roller 42 in the neighborhood of the non-driving side end portion as seen in a direction, indicated by an arrow V in FIG. 22, from an inside of the developing device frame 44 toward the non-driving side bearing member 46.

In this embodiment, the non-driving side bearing member 46 is provided with a locking plate 46*g* as an elastically deformable phase-determining portion.

The locking plate 46*g* includes an arm-like base portion 40*g*1 as an elastically deformable portion extended toward the developing device frame 44 with respect to the longitudinal direction of the developing device 4 and includes a locking portion 46*g*2 provided in the neighborhood of an end of the base portion 46*g*1. In this embodiment, the base portion 46*g*1 of the locking plate 46*g* is provided above the developing roller supporting hole 46*b*, and the locking portion 46*g*2 of the locking plate 46*g* extends along a direction toward the center axis of the core material 41*a* of the developing roller 41 to be located below the locking plate 46*g* and also along the longitudinal direction of the developing device 4. Further, the locking plate 46*g* is configured to be movable, by elastic deformation of the base portion 46*g*1, in a direction in which the locking portion 46*g*2 is moved away from the core material 41*a* of the developing roller 41 as indicated by an arrow A6 in FIG. 22.

Further, in this embodiment, the spacer member 48 includes the annular portion 48*a* having a predetermined thickness with respect to the longitudinal direction of the developing device 4. Further, the spacer member 48 includes the contact portion 48*b* projected from the annular portion 48*a* toward the outside of the annular portion 48*a* with respect to the radial direction of the annular portion 48*a*. In this embodiment, the annular portion 48*a* and the contact portion 48*b* have the same predetermined thickness with respect to the longitudinal direction of the developing device 4 and have flush longitudinal side surfaces. Further, in this embodiment, the spacer member 48 is provided with a cut-away portion 48*d* as the portion-to-be-phase-determined-portion at the outer peripheral surface of the annular portion 48*a*. The cut-away portion 48*d* is formed in a shape extending along the longitudinal direction of the developing device 4. The spacer member 48 is rotatably supported by the core material 41*a* of the developing device 4 by the engagement of the core material 41*a* of the developing roller 41 with the inner diameter portion 48*a*1 of the annular portion 48*a*.

In this embodiment, by the locking plate 46*g* and the cut-away portion 48*d*, the phase determining means for determining the phase of the spacer member 48 at the phase where the developing roller 41 and the photosensitive drum 1 are spaced is constituted.

Further, the locking portion 46*g*2 of the locking plate 46*g* of the non-driving side bearing member 46 is engaged with the cut-away portion 48*d* of the spacer member 48 to determine the phase of the spacer member 48. As a result, the state in which the developing roller 41 is spaced from the photosensitive drum 1 by the spacer member 48 is maintained.

When the user starts the use of the process cartridge 120, the locking portion 46*g*2 of the locking plate 46*g* is disengaged from the cut-away portion 48*d* of the spacer member 48. A subsequent process is approximately the same as that in the case of Embodiment 2 and therefore will be omitted from detailed description.

As described above, also by the constitution in this embodiment, the effects similar to those in Embodiments 1 and 2 can be obtained. Further, in this embodiment, the constitution of the phase-determining means for the spacer member can be made relatively simple.

(Embodiment 7)

Next, another embodiment of the present invention will be described basic constitutions and operations of the developing device, the process cartridge and the image forming apparatus in this embodiment are the same as those in Embodiments 1 and 2. Therefore, elements having the same or corresponding functions and constitutions as those for the image forming apparatus in Embodiments 1 and 2 are represented by the same reference numerals or symbols and will be omitted from detailed description.

In this embodiment, the spacer member 48 is mounted on a non-driving side end surface 44*a* of the developing device frame 44 with respect to the longitudinal direction of the developing device 4.

FIG. 24 is an assembling perspective view showing the developing device 4 at the non-driving side end portion with respect to the longitudinal direction of the developing device 4.

In this embodiment, on the non-driving side end surface 44*a* of the developing device frame 44 with respect to the longitudinal direction of the developing device 4, a cylindrical supporting portion 44*d* is provided so as to be projected toward the outside of the developing device frame 44 with respect to the longitudinal direction.

Further, in the neighborhood of the supporting portion 44*d*, a locking plate 44*e* as the elastically deformable phase-determining portion is provided. A constitution of the locking plate 44*e* is approximately the same as that described in Embodiment 4.

That is, the locking plate 44*e* includes an arm-like base portion 44*e*1 extended from the non-driving side end surface 44*a* of the developing device frame 44 toward the outside of the developing device 4 with respect to the longitudinal direction of the developing device 4 and includes a locking portion 44*e*2 provided in the neighborhood of an end of the base portion 44*e*1. The base portion 44*e*1 of the locking plate 44*e* is provided obliquely above the supporting portion 44*d*, and the locking portion 44*e*2 of the locking plate 44*e* extends along a direction toward the center axis of the supporting portion 44*d* located obliquely below the locking plate 44*e* and also along the longitudinal direction of the developing device 4. Further, the locking plate 44*e* is configured to be movable, by elastic deformation of the base portion 44*e*1, in a direction in which the locking portion 44*e*2 is moved away from the supporting portion 44*d*.

Further, in this embodiment, the spacer member 48 includes the annular portion 48*a* having a predetermined thickness with respect to the longitudinal direction of the developing device 4. Further, the spacer member 48 includes the contact portion 48*b* projected from the annular portion 48*a* toward the outside of the annular portion 48*a* with respect to the radial direction of the annular portion 48*a*. In this embodiment, the annular portion 48*a* and the contact portion 48*b* have substantially the same predetermined thickness with respect to the longitudinal direction of the developing device 4 and have substantially flush longitudinal side surfaces. However, in this embodiment, an end portion of the contact portion 48*b* is extended in the longitudinal direction of the developing device 4. Further, in this embodiment, the spacer member 48 is provided, at the outer peripheral surface of the annular portion 48*a*, with a first cut-away portion 48*e* as the portion-to-be-phase-determined-portion (first portion-to-be-phase-determined-portion) and a second cut-away portion 48*f* as the portion-to-be-phase-determined-portion after the spacing elimination (second portion-to-be-phase-determined-portion. The first and second cut-away portions 48*e* and 48*f* are each formed in a shape extending along the longitudinal direction of the developing device 4. The spacer member 48 is rotatably supported by the supporting portion 44*d* by the engagement of the supporting portion 44*d* of the developing device frame 44 with the inner diameter portion 48*a*1 of the annular portion 48*a*.

Further, when the non-driving side bearing member 46 is mounted to the developing device frame 44, the supporting portion 44*d* of the developing device frame 44 is engaged with the supporting hole 46*h* of the non-driving side bearing member 46, so that the spacer member 48 is mounted without being disengaged from the supporting portion 44*e*.

Parts (a) and (b) of FIG. 25 are side views for illustrating an operation in which the state of the spacer member 48 is changed from the state, in which the developing roller 41 is spaced from the photosensitive drum 1, to a state in which the spaced state by the spacer member 48 is eliminated to realize the contact between the developing roller 41 and the photosensitive drum 1. In (a) and (b) of FIG. 25, the non-driving side cover member 125 and the non-driving side bearing member 46 were omitted.

Incidentally, in this embodiment, as described in Embodiment 3, the constitution in which the spacer member 48 is rotated by the spacing-eliminating portion 1*c* formed on the non-driving side end portion member 1*b* of the photosensitive drum 1 is employed.

Part (a) of FIG. 25 shows the state in which the developing roller 41 is spaced from the photosensitive drum 1 by the spacer member 48. In this state, the locking portion 44*e*2 of the locking plate 44*e* is engaged with the first cut-away portion 48*e* of the spacer member 48 to determine the phase of the spacer member 48.

Here, the spacer member 48 mounted to the supporting portion 44*d* as the (rotational) fulcrum. The contact portion 48*b* of the spacer member 48 is located between the supporting portion 44*d* and the rotational axis B2 of the photosensitive drum 1.

Similarly as in Embodiment 1, by using such an arrangement, the strength for maintaining the spaced state between the developing roller 41 and the photosensitive drum 1 by the spacer member 48 can be enhanced, so that the parts can be downsized.

Part (b) of FIG. 25 shows the state in which the spaced state between the developing roller 41 and the photosensitive drum 1 is eliminated. Concurrently with the rotation of the photosensitive drum 1, the spacing-eliminating portion 1*c* of the non-driving side end portion member 1*b* of the photosensitive drum 1 is rotated in the arrow R1 direction in the figure. As a result, the spacing-eliminating portion 1*c* rotates the spacer member 48 in the arrow A3 direction in the figure, so that the spaced state between the developing roller 41 and the photosensitive drum 1 by the spacer member 48 is eliminated. In this state, the locking portion 44*e*2 of the locking plate 44*e* is engaged with the second cut-away portion 48*f* of the spacer member 48 to determine the phase of the spacer member 48.

In this embodiment, by the locking plate 44*e* and the first cut-away portion 48*e*, of the spacer member 48, the phase determining means for determining the phase of the spacer member 48 at the first phase where the developing roller 41 and the photosensitive drum 1 are spaced is constituted. Further, in this embodiment, by the locking plate 44*e* and the second cut-away portion 48*f*, the phase-determining means after the spacing elimination is constituted. The phase-determining means after the spacing elimination determines, after the spaced state between the developing roller 41 and the photosensitive drum 1 by the spacer member 48 is eliminated, the phase of the spacer member at the second phase where the spacer member 48 is retracted from the photosensitive drum 1 to be in non-contact with the photosensitive drum 1.

Thus, in this embodiment, the spacer member 48 includes the second cut-away portion 48*f* as the portion-to-be-phase-determined-portion after the spacing elimination. The second cut-away portion 48*f* determines, after the contact state of the contact portion 48*b* with the photosensitive member 1 or the end portion member 1*b* is eliminated, the position of the spacer member 48 with respect to the rotational direction at the position where the contact portion 48*b* is in non-contact with the photosensitive member 1 by the action of the locking plate 44*e* as the phase-determining portion. In this embodiment, the first cut-away portion 48*e* as the portion-to-be-phase-determined-portion is located downstream of the second cut-away portion 48*f* with respect to the rotational direction of the spacer member 48 when the contact state is eliminated.

As described above, also by the constitution in this embodiment, the effects similar to those in Embodiments 1 and 2 can be obtained. Further, in this embodiment, the constitution of the phase-determining means for the spacer member can be made relatively simple. Further, similarly as in Embodiment 4, it is possible to obviate the contact between the spacer member 48 and the photosensitive drum 1 with reliability after the spaced state between the developing roller 41 and the photosensitive drum 1 by the spacer member 48 is eliminated.

(Other Embodiments)

In the above, the present invention is described based on the specific embodiments but is not limited thereto.

For example, in the above-described embodiments, the normal portion-preventing portion for preventing the excessive rotation of the spacer member in the normal rotational direction is provided on the developing device frame but may also be provided on, e.g., the non-driving side bearing member.

Further, in Embodiments 2 and 4, the elastically deformable portion is provided at a part of the spacer member, but as described in Embodiments 6 and 7, may also be provided on, e.g., the non-driving side bearing member or the developing device frame.

Further, in the above-described embodiments, the spacer member was rotatably supported by engaging the shaft member (such as the core material of the developing roller or the columnar or cylindrical supporting portion), provided to the supporting frame (such as the developing device frame or the bearing member), with the inner diameter portion of the annular portion as the support-receiving portion. However, the present invention is not limited thereto. For example, as shown in FIG. 26, the shaft portion 48*g* as the support-receiving portion is provided to the spacer member 48, and a hole 46*f* as a bearing is provided in the supporting frame. By engaging these portions, the spacer member 48 may also be rotatably supported.

Further, in the above-described embodiments, as the electrophotographic image forming apparatus, the full-color electrophotographic image forming apparatus to which the four process cartridges are detachably mountable was described as the example. However, the number of the process cartridges mounted in the electrophotographic image forming apparatus is not limited to four but is appropriately set as desired. For example, in the case of an image forming apparatus for forming a monochromatic image, the number of the process cartridge mounted in the electrophotographic image forming apparatus is one.

Further, in the above-described embodiments, the printer was described as the example of the image forming apparatus. However, the present invention is not limited to the printer but is also applicable to other image forming apparatuses such as the copying machine, the facsimile machine and the multifunction machine having a combination of functions of these machines.

Further, the present invention is not limited to embodiments such as the above-described embodiments, in which the process unit is, as the process cartridge, easily mounted to and demounted from the main assembly of the image forming apparatus so as to be replaceable. Even in the case where the process unit is shipped in a state in which it is mounted in the image forming apparatus, in order to prevent in advertent contact of the process member during distribution or storage before use or the like, the process member is shipped in a spaced state from the photosensitive member more than during the use in some cases. Thus, also in the case where the constitution in which the process member is spaced from the photosensitive member more than during the use is employed in a state in which the process unit is mounted in the image forming apparatus, the present invention is equally applicable, so that the effects similar to those described above can be achieved.

Further, the process member which is desired to be kept in the spaced state from the photosensitive member, more than during the use, during the distribution or storage before the use is not limited to the developer carrying member as in the above-described embodiments. For example, in general, the charging roller as the charging means and the cleaning blade as the cleaning means which are contacted to the photosensitive member during the use are formed with an elastic material such as a rubber material. Further, when such charging roller and cleaning blade are kept contacted to the photosensitive member during distribution or storage before the use, there is a possibility that these members are deformed and that a substance which bleeds from these members adversely affects the photosensitive member. Therefore, in some cases, it is desired that these process members other than the developer carrying member are kept in the spaced state from the photosensitive member, more than during the use, during the distribution or storage. The present invention is equally applicable to these process members other than the developer carrying member, so that the effects similar to those in the above-described embodiments can be achieved. For example, as shown in FIG. 27, similarly as in the case of the developing device frame 44 in the above-described embodiments, the cleaning container 62 as the supporting frame for supporting the charging roller 2 and the cleaning blade 61 can be mounted to, e.g., the developing device frame 44 so as to be rotatable in arrow A7 and A8 directions in the figure.

Then, during the distribution or storage or the like before the use, by the spacer member 48 rotatably mounted to the rotation shaft (core material) of the charging roller 2 or the supporting portion for the cleaning container 62, the charging roller 2 and the cleaning blade 61 can be spaced from the photosensitive drum 1. Further, with respect to the phase-determining means for the spacer member 48, the means similar to those in the above-described embodiments can be applied, so that the effects similar to those in the above-described embodiments can be obtained.

Further, in the above-described embodiments, the preventing member for placing the member and the process member in the spaced state more than during the use was described as the spacer member for spacing the process member, to be contacted to the photosensitive drum during the use, from the photosensitive member during the distribution or storage before the use.

However, as described above, even with respect to the process member which does not contact the photosensitive member during use, in some cases, it is desired that the process member is more spaced from the photosensitive member than during use in order to prevent inadvertent contact with the photosensitive member during distribution or storage before use. The present invention is equally applicable to also such cases and can obtain the effects, similar to those in the above-described embodiments, in addition to the prevention of the in advertent contact of the process member with the photosensitive member during the distribution or storage before the use.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 286356/2011 filed Dec. 27, 2011, which is hereby incorporated by reference.

What is claimed is:

1. A cartridge detachably mountable to a main assembly of an image forming apparatus, the cartridge comprising:

a rotatable image bearing member on which an image is to be formed;

a spacer member movable by rotation between a first position where a process member actable on said image bearing member is spaced from said image bearing member and a second position where the process member is permitted to contact said image bearing member, wherein the spacer member includes (i) an arm portion extending toward an upstream side with respect to a movement direction of said spacer member from the first position to the second position, (ii) a contact portion contacting said image bearing member when said spacer member is located at the first position, and (iii) a first portion-to-be-engaged, provided at said arm portion, for holding said spacer member at the first position by being engaged with a first engaging portion, and wherein by rotation of the image bearing member engagement between said first portion-to-be-engaged and the first engaging portion is eliminated to move said spacer member from the first position to the second position.

2. A cartridge according to claim 1, wherein said spacer member is prevented from moving from the second position to the first position by being engaged with a second engaging portion when said spacer member is located at the second position.

3. A cartridge according to claim 2, wherein the second engaging portion is configured to be engaged with said first portion-to-be-engaged.

4. A cartridge according to claim 2, further comprising a guide for guiding said first portion-to-be-engaged from the first engaging portion to the second engaging portion when said spacer member is moved from the first position to the second position.

5. A cartridge according to claim 2, wherein the first engaging portion is located upstream of the second engaging portion with respect to a direction in which said spacer member is moved from the first position to the second position.

6. A cartridge according to claim 1, further comprising a preventing portion for preventing movement of said spacer member in a direction opposite to a direction in which said spacer member is moved from the first position to the second position.

7. A cartridge according to claim 1, wherein one of said first portion-to-be-engaged and the first engaging portion includes an elastically deformable portion for being elastically deformed by the other of said first portion-to-be-engaged and the first engaging portion when the engagement between said first portion-to-be-engaged and the first engaging portion is eliminated.

8. A cartridge according to claim 7, wherein said spacer member receives a force, generated when deformation of the elastically deformable portion is eliminated, for moving said spacer member from the first position to the second position.

9. A cartridge according to claim 1, wherein said spacer member further includes a second portion-to-be-engaged for being engaged with the first engaging portion after said spacer member is moved to the second position, said second portion-to-be-engaged holding said spacer member at the second position by being engaged with the first engaging portion.

10. A cartridge according to claim 9, wherein said first portion-to-be-engaged is located downstream of said second portion-to-be-engaged with respect to a direction in which said spacer member is moved from the first position to the second position.

11. A cartridge according to claim 1, wherein said contact portion is located between a rotational axis of said image bearing member and a rotational axis of said spacer member when said spacer member is at the first position.

12. A process cartridge according to claim 1, wherein said spacer member further comprises an annular portion, having an annular shape, for being engaged with a shaft portion, and wherein said arm portion extends from said annular portion toward the upstream side.

13. A cartridge according to claim 1, further comprising a preventing portion for preventing, after said spacer member is moved to the second position, movement of said spacer member toward downstream side of the second position with respect to a direction in which said spacer member is moved from the first position to the second position.

14. A cartridge according to claim 1, wherein the process member is a developer carrying member for supplying a developer to said image bearing member.

15. A cartridge according to claim 1, wherein said spacer member is mounted on a shaft portion of the process member.

16. A cartridge according to claim 1, wherein said spacer member is moved from the first position to the second position by a frictional force that is generated by rotation of said image bearing member.

17. A cartridge according to claim 1, further comprising an end portion member provided at an end portion of said image bearing member with respect to a rotational axis direction of said image bearing member, said end portion member including an urging portion, and wherein, when said image bearing member is rotated, said urging portion urges said contact portion to move said spacer member from the first position to the second position.

18. A cartridge according to claim 17, wherein said end portion member is a flange.

19. A cartridge according to claim 1, further comprising a first unit including said image bearing member; and a second unit including the process member, wherein said second unit is rotatably connected to said first unit.

20. An image forming apparatus for forming an image on a recording material, the image forming apparatus comprising:

cartridge according to claim 1; and the main assembly.

21. A process cartridge according to claim 19, said spacer member is rotatably provided in said second unit.

22. A cartridge according to claim 1, wherein said contact portion does not contact said image bearing member when said spacer member is located at the second position.

23. A cartridge according to claim 1, further comprising an end portion member provided at an end portion of said image bearing member with respect to a rotational axis direction of said image bearing member, and wherein said contact portion does not contact said end portion member when said spacer member is located at the second position.

24. A cartridge according to claim 1, further comprising an end portion member provided at an end portion of said image bearing member with respect to a rotational axis direction of said image bearing member, and wherein said contact portion has a width in the rotational axial direction such that said contact portion faces both of said image bearing member and said end portion member.

25. A cartridge detachably mountable to a main assembly of an image forming apparatus, the cartridge comprising:

a rotatable image bearing member on which an image is to be formed;

a spacer member movable by rotation between a first position where a process member actable on said image bearing member is spaced from said image bearing member and a second position where the process member is permitted to contact said image bearing member, wherein said spacer member includes (i) an arm portion extending toward an upstream side with respect to a movement direction of said spacer member from the first position to the second position, (ii) a contact portion contacting an end portion member provided at an end portion of said image bearing member with respect to a longitudinal direction of said image bearing member when said spacer member is located at the first position, and (iii) a first portion-to-be-engaged, provided at said arm portion, for holding said spacer member at the first position by being engaged with a first engaging portion, and wherein by rotation of said image bearing member, engagement between said first portion-to-be-engaged and the first engaging portion is eliminated to move said spacer member from the first position to the second position.

26. A cartridge according to claim 25, wherein said spacer member is prevented from moving from the second position to the first position by being engaged with a second engaging portion when said spacer member is located at the second position.

27. A cartridge according to claim 26, wherein said second engaging portion is configured to be engaged with said first portion-to-be-engaged.

28. A cartridge according to claim 26, wherein the first engaging portion is located upstream of the second engaging portion with respect to a direction in which said spacer member is moved from the first position to the second position.

29. A cartridge according to claim 25, further comprising a preventing portion for preventing, after said spacer member is moved to the second position, movement of said spacer member toward downstream side of the second position with respect to a direction in which said spacer member is moved from the first position to the second position.

30. A cartridge according to claim 25, further comprising a preventing portion for preventing movement of said spacer member in a direction opposite to a direction in which said spacer member is moved from the first position to the second position.

31. A cartridge according to claim 25, further comprising a guide for guiding said first portion-to-be-engaged from the first engaging portion to the second engaging portion when said spacer member is moved from the first position to the second position.

32. A cartridge according to claim 25, wherein one of said first portion-to-be-engaged and the first engaging portion includes an elastically deformable portion for being elastically deformed by the other of said first portion-to-be-engaged and the first engaging portion when the engagement between said first portion-to-be-engaged and the first engaging portion is eliminated.

33. A cartridge according to claim 32, wherein said spacer member receives a force, generated when deformation of the elastically deformable portion is eliminated, for moving said spacer member from the first position to the second position.

34. A cartridge according to claim 25, wherein said spacer member further includes a second portion-to-be-engaged for being engaged with the first engaging portion after said spacer member is moved to the second position, said second portion-to-be-engaged holding said spacer member at the second position by being engaged with the first engaging portion.

35. A cartridge according to claim 34, wherein said first portion-to-be-engaged is located downstream of said second portion-to-be-engaged with respect to a direction in which said spacer member is moved from the first position to the second position.

36. A cartridge according to claim 25, wherein said spacer member is configured to be rotated from the first position to the second position.

37. A cartridge according to claim 36, wherein said contact portion is located between a rotational axis of said image bearing member and a rotational axis of said spacer member when said spacer member is at the first position.

38. A cartridge according to claim 25, wherein said spacer member is mounted on a shaft portion of the process member.

39. A cartridge according to claim 25, wherein said spacer member further comprises an annular portion having an annular shape, and wherein said arm portion extends from said annular portion toward the upstream side.

40. A cartridge according to claim 25, wherein the process member is a developer carrying member for supplying a developer to the image bearing member.

41. A cartridge according to claim 25, wherein said spacer member is moved from the first position to the second position by a frictional force that is generated by rotation of said image bearing member.

42. A cartridge according to claim 25, wherein said end portion member includes an urging portion, and wherein, when said image bearing member is rotated, said urging portion urges said contact portion to move said spacer member from the first position to the second position.

43. A cartridge according to claim 42, wherein said end portion member is a flange.

44. A cartridge according to claim 25, wherein said contact portion does not contact said image bearing member when said spacer member is located at the second position.

45. A cartridge according to claim 25, wherein said contact portion does not contact said end portion member when said spacer member is located at the second portion.

46. A cartridge according to claim 25, further comprising a first unit including the image bearing member; and a second unit including the process member, wherein said second unit is rotatably connected to said first unit.

47. A cartridge according to claim 25, wherein said contact portion has a width in the rotational axial direction such that said contact portion faces both of said image bearing member and said end portion member and the end portion member.

48. An image forming apparatus for forming an image on a recording material, comprising:

a cartridge according to claim 25; and the main assembly.

* * * * *